US012716191B2

(12) United States Patent
Fukuda

(10) Patent No.: US 12,716,191 B2
(45) Date of Patent: Aug. 25, 2026

(54) WORKING MACHINE

(71) Applicant: Kubota Corporation, Osaka (JP)

(72) Inventor: Yuji Fukuda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 28 days.

(21) Appl. No.: 19/027,238

(22) Filed: Jan. 17, 2025

(65) Prior Publication Data

US 2026/0210070 A1 Jul. 23, 2026

(51) Int. Cl.
*E02F 3/43* (2006.01)
*E02F 9/20* (2006.01)

(52) U.S. Cl.
CPC ..... *E02F 3/432* (2013.01); *E02F 9/2033* (2013.01)

(58) Field of Classification Search
CPC ..... E02F 3/432; E02F 9/2033
USPC ..... 701/50
See application file for complete search history.

(56) References Cited

U.S. PATENT DOCUMENTS

2020/0048871 A1* 2/2020 Nishizawa ..... B60Q 9/008
2021/0214919 A1* 7/2021 Okada ..... E02F 3/437
2022/0282459 A1* 9/2022 Chiba ..... E02F 9/2033
2022/0290411 A1* 9/2022 Anahara ..... E02F 9/265
2024/0017970 A1* 1/2024 Yamamoto ..... E02F 3/962

FOREIGN PATENT DOCUMENTS

JP 2012207531 A 10/2012

* cited by examiner

*Primary Examiner* — Kira Nguyen
*Assistant Examiner* — Khoi H Tran
(74) *Attorney, Agent, or Firm* — Keating & Bennett, LLP

(57) ABSTRACT

A working machine includes a working device attached to a machine body to attach thereto an attachment and change a posture of the attached attachment, a work manual operator to be operated to actuate the working device to change the posture, a first input interface to receive input of information relating to the attached attachment, and a controller configured or programmed to control the working device. The controller is configured or programmed to, based on the information inputted via the first input interface, define a work posture range for work performed by the attachment and a travel posture range for the machine body to travel, and when the work manual operator is operated to actuate the working device and the posture of the attachment changes to a posture within the travel posture range or work posture range, stop actuating the working device even while the work manual operator is operated.

17 Claims, 20 Drawing Sheets

Fig.5

| Attachment information | Control information |
|---|---|
| Identification information: A1<br>Name: Bucket<br>Icon data<br>Model number, specifications | Posture information<br>(work posture range, travel posture range)<br>etc. |
| Identification information: A2<br>Name: Sweeper<br>Icon data<br>Model number, specifications | Default value of fluid flow rate<br>Posture information<br>(work posture range, travel posture range)<br>etc. |
| Identification information: A3<br>Name: Angle broom<br>Icon data<br>Model number, specifications | Default value of fluid flow rate<br>Posture information<br>(work posture range, travel posture range)<br>etc. |
| Identification information: A4<br>Name: Rake<br>Icon data<br>Model number, specifications | Default value of fluid flow rate<br>Posture information<br>(work posture range, travel posture range)<br>etc. |
| Identification information: A5<br>Name: Grapple<br>Icon data<br>Model number, specifications | Default value of fluid flow rate<br>etc. |
| ⋮ | ⋮ |
| Identification information: A8<br>Name: Snow blower<br>Icon data<br>Model number, specifications | Default value of fluid flow rate<br>Posture information<br>(work posture range, travel posture range)<br>etc. |
| Identification information: A9<br>Name: Spreader<br>Icon data<br>Model number, specifications | Default value of fluid flow rate<br>etc. |
| ⋮ | ⋮ |

WORKING MACHINE

BACKGROUND OF THE INVENTION

1. Field of the Invention

The present invention relates to working machines such as skid-steer loaders and compact track loaders, and particularly relates to techniques to perform work using each of various types of attachments attached to a working device including arms and the like.

2. Description of the Related Art

Working machines such as skid-steer loaders and compact track loaders each include a machine body, a traveling device to support the machine body to allow the machine body to travel, and a working device attached to the machine body (for example, Japanese Unexamined Patent Application Publication No. 2012-207531). With regard to this kind of working machine, the user attaches one of the attachments which perform various types of work to the working device and manually operates the working device to change/adjust the posture (such as the position and orientation) of the attachment to a posture suitable for travel of the working machine or the posture suitable for work. However, it is not easy and is tiring for the user to manually operate the working device to change/adjust the posture of the attachment again and again.

SUMMARY OF THE INVENTION

Example embodiments of the present invention make it possible to reduce the burden on the user to operate the working machine to change the posture of the attachment.

A working machine according to an example embodiment of the present invention includes a machine body, a working device attached to the machine body, the working device being operable to attach thereto an attachment which is one of a plurality of attachments to perform work, and change a posture of the attachment attached thereto including a position of the attachment in an up-down direction, a work manual operator to be operated to actuate the working device to change the posture of the attachment, a first input interface to receive input of information relating to the attachment attached to the working device, and a controller configured or programmed to control the working device, wherein the controller is configured or programmed to, based on the information inputted via the first input interface, define a work posture range for the work performed by the attachment and a travel posture range for the machine body to travel, the travel posture range differing from the work posture range, and when the work manual operator is operated to actuate the working device and the posture of the attachment changes to a posture falling within the travel posture range or the work posture range, stop actuating the working device even while the work manual operator is being operated.

In an example embodiment of the present invention, the working machine may further include a seat. The controller may be configured or programmed to, in a case that the attachment corresponding to the information inputted via the first input interface is an attachment to perform work by contacting a target object, define, based on the information, the work posture range in which the attachment contacts the target object and the travel posture range in which the attachment is positioned lower than the seat and is not in contact with the target object.

In an example embodiment of the present invention, the controller may be configured or programmed to stop actuating the working device when the work manual operator is operated, while the posture of the attachment is in the work posture range, in the travel posture range, or in an in-between range between the work posture range and the travel posture range, to actuate the working device and the posture of the attachment changes to a posture falling within the travel posture range or the work posture range.

In an example embodiment of the present invention, the controller may be configured or programmed to, when the work manual operator is operated to actuate the working device while the posture of the attachment is not in the work posture range, in the travel posture range, or in the in-between range, not stop actuating the working device as long as the work manual operator is being operated even when the posture of the attachment changes to a posture falling within the travel posture range or the work posture range.

In an example embodiment of the present invention, the controller may be configured or programmed to, when the work manual operator is operated to actuate the working device and the posture of the attachment changes to the travel posture range, stop actuating the working device to set the posture of the attachment at a predetermined travel posture falling within the travel posture range, and when the work manual operator is operated to actuate the working device and the posture of the attachment changes to the work posture range, stop actuating the working device to set the posture of the attachment at a predetermined work posture falling within the work posture range.

In an example embodiment of the present invention, the working machine may further include a detector to detect a posture of the working device that includes a position of the working device in an up-down direction. The controller may be configured or programmed to stop actuating the working device when the work manual operator is operated to actuate the working device and the posture of the working device changes to a posture falling within a range corresponding to the travel posture range or a range corresponding to the work posture range.

In an example embodiment of the present invention, the working device may include an arm connected to the machine body swingably in the up-down direction, and a hitch connected to a distal portion of the arm to attach and detach the attachment thereto and therefrom, and a first actuator to swing the arm. The controller may be configured or programmed to stop actuating the first actuator when the work manual operator is operated, while an actuated position of the first actuator is in a first range corresponding to the work posture range, in a second range corresponding to the travel posture range, or in a third range between the first range and the second range, to actuate the first actuator and the actuated position of the first actuator changes to the second range or the first range.

In an example embodiment of the present invention, the controller may be configured or programmed to reduce an actuation speed of the first actuator as the actuated position of the first actuator approaches from the third range to the second range or to the first range.

In an example embodiment of the present invention, the hitch may be connected to the distal portion of the arm swingably in the up-down direction. The working device may include a second actuator to swing the hitch. The controller may be configured or programmed to stop actuating the second actuator when the work manual operator is operated, while an actuated position of the second actuator is in a fourth range corresponding to the work posture range, in a fifth range corresponding to the travel posture range, or in a sixth range between the fourth range and the fifth range, to actuate the second actuator and the actuated position of the second actuator changes to the fifth range or the fourth range.

In an example embodiment of the present invention, the controller may be configured or programmed to reduce an actuation speed of the second actuator as the actuated position of the second actuator approaches from the sixth range to the fifth range or to the fourth range.

In an example embodiment of the present invention, the controller may be configured or programmed to, when, after the work manual operator is operated in a first direction and the posture of the attachment changes to a posture falling within the travel posture range or the work posture range and actuation of the working device is stopped, the work manual operator is operated to a neutral position and then is operated again in the first direction, permit the posture of the attachment to change to another posture not falling within the travel posture range or the work posture range by actuation of the working device caused by the work manual operator thus operated again.

In an example embodiment of the present invention, the working machine may further include a power output circuit to output power to an auxiliary actuator provided in or on the attachment to drive the attachment. The controller may be configured or programmed to, in a case that the attachment indicated by the information inputted via the first input interface is a specific attachment including the auxiliary actuator, stop actuating the working device when the work manual operator is operated while the controller is in a steady output mode and the posture of the attachment is within the work posture range, within the travel posture range, or within the in-between range and the posture of the attachment changes to a posture falling within the travel posture range or the work posture range, the steady output mode being a mode in which the controller keeps constant a state of power output from the power output circuit to the auxiliary actuator.

In an example embodiment of the present invention, the controller may be configured or programmed to, when the controller is not in the steady output mode, permit the posture of the attachment to change to another posture not falling within the travel posture range or the work posture range by actuation of the working device caused by operation of the work manual operator.

In an example embodiment of the present invention, the controller may be configured or programmed to not enter the steady output mode when the posture of the attachment does not fall within the work posture range, the travel posture range, or the in-between range.

In an example embodiment of the present invention, the controller may be configured or programmed to select, from a memory and/or a storage to store one or more of the work posture ranges and one or more of the travel posture ranges defined for a respective one or more of the attachments attachable to the working device, information relating to the corresponding work posture range and information relating to the corresponding travel posture range based on the information inputted via the first input interface.

In an example embodiment of the present invention, the controller may be configured or programmed to select information relating to at least one of the work posture range or the travel posture range included in the information inputted via the first input interface.

In an example embodiment of the present invention, the working machine may further include a second input interface to receive input of a changed value of the work posture range and/or the travel posture range defined by the controller.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

FIG. 5 illustrates an example of attachment information and control information.

DETAILED DESCRIPTION OF THE EXAMPLE EMBODIMENTS

Figure 1:
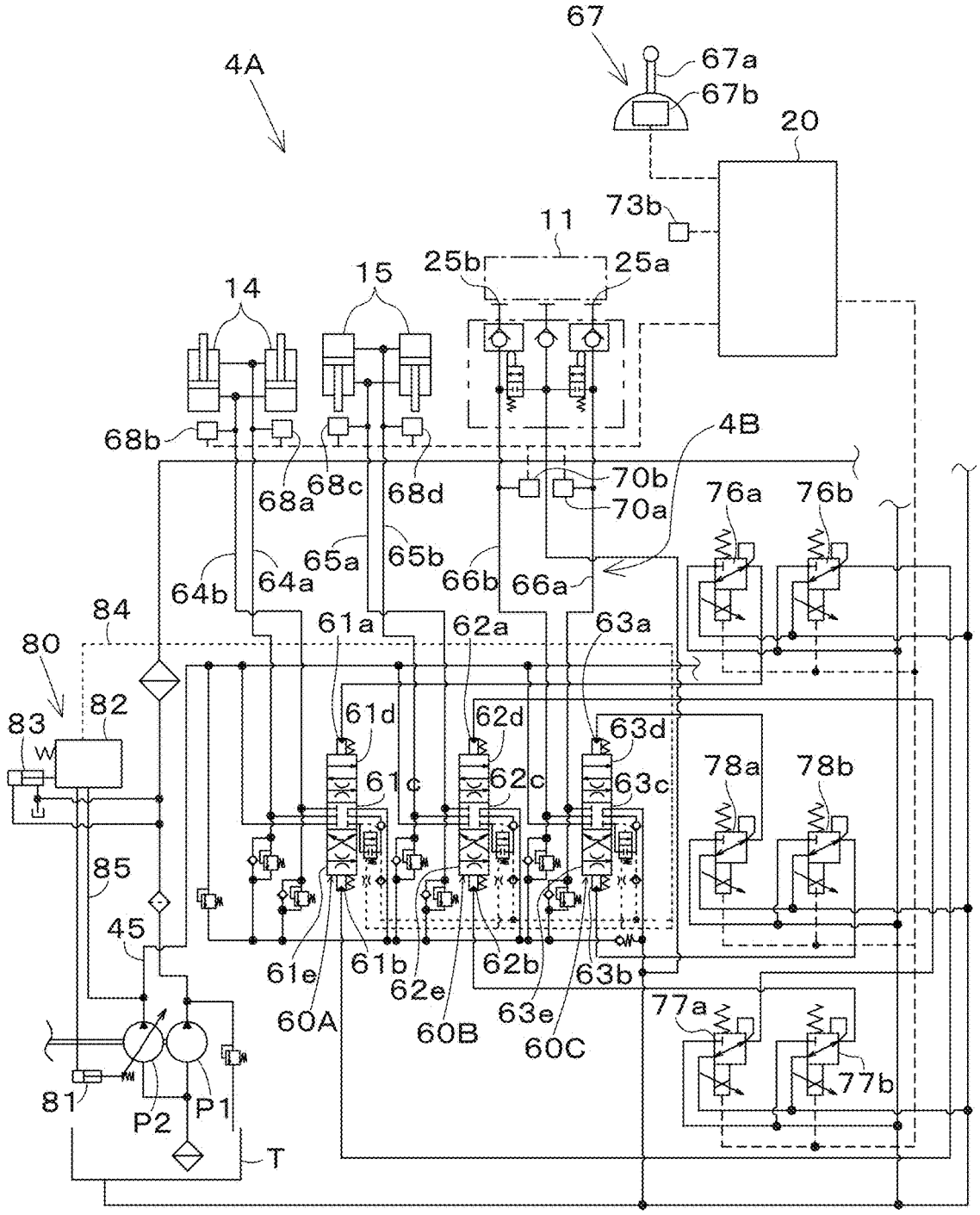
FIG. 1 illustrates an example of a work-related hydraulic circuit of a working machine.

Example embodiments will now be described with reference to the accompanying drawings, wherein like reference numerals designate corresponding or identical elements throughout the various drawings. The drawings are to be viewed in an orientation in which the reference numerals are viewed correctly.

Example embodiments of the present invention will now be described with reference to the accompanying drawings as necessary.

Figure 12:
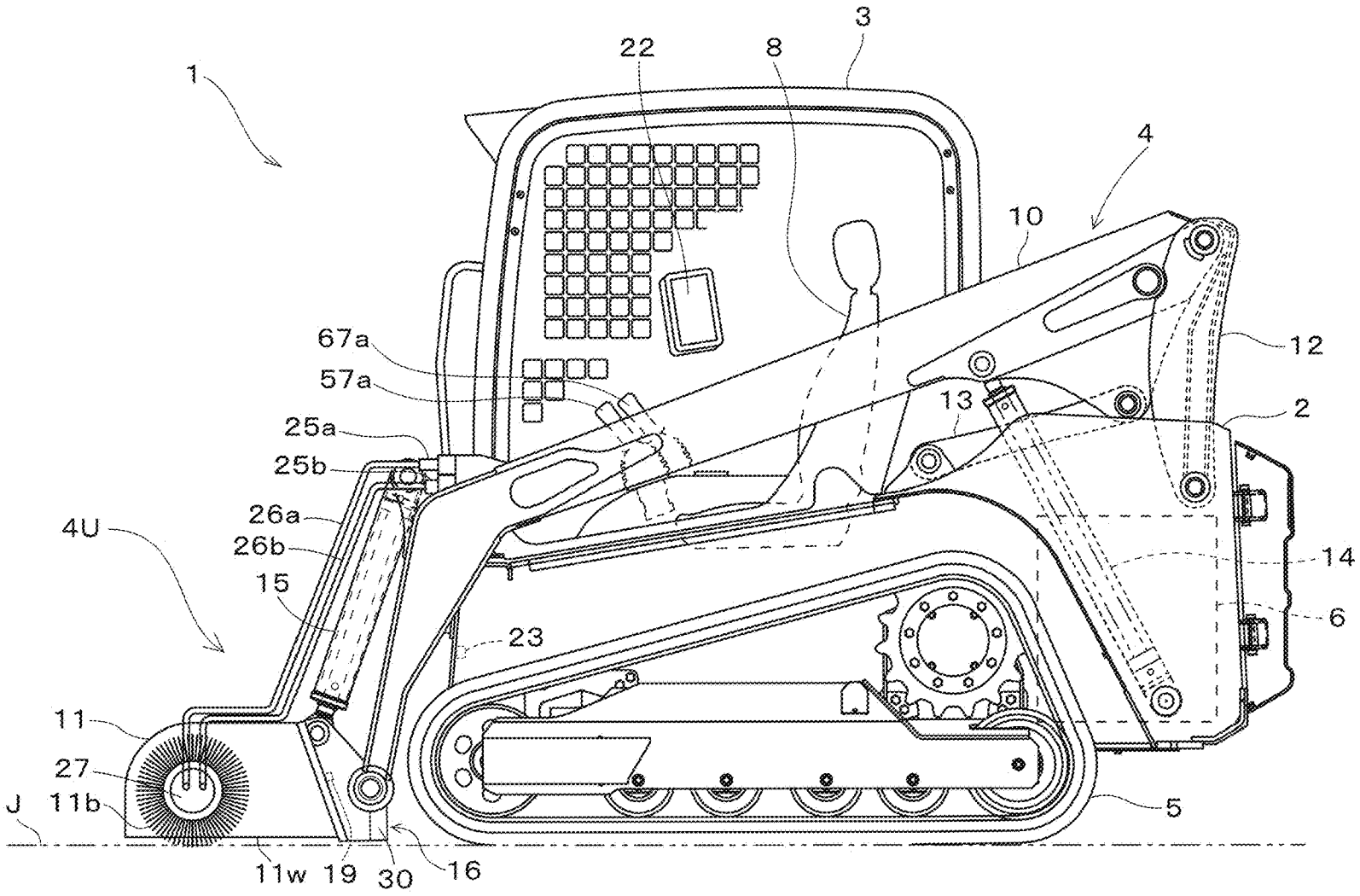
FIG. 12 is a side view of a working vehicle.

FIG. 12 is a side view of a working machine 1 of the present example embodiment. In the present example embodiment, a compact track loader is illustrated as an example of the working machine 1. However, the working machine according to an example embodiment of the present invention is not limited to a compact track loader, and may be, for example, some other construction machine, agricultural machine, or working machine such as a skid-steer loader, a backhoe, or a tractor. The left direction, right direction, the direction approaching the viewer of FIG. 12, and the direction away from the viewer of FIG. 12 are respectively forward, rearward, left and right directions of the working machine 1. The direction perpendicular to the front-back direction and the up-down direction of the working machine 1 is hereinafter referred to as a machine body width direction.

The working machine 1 includes a machine body 2, a cabin 3, a working device 4, traveling device(s) 5, and a prime mover 6. The cabin 3 is provided on the machine body 2. The cabin 3 includes a seat 8 therein. The prime mover 6 is provided at a rear portion of the machine body 2. The prime mover 6 is a power source of the working machine 1. In the present example embodiment, the prime mover 6 includes a diesel engine. However, the prime mover 6 may be another internal combustion engine (engine) such as a gasoline engine, and/or may be a motor such as an electric motor.

The traveling devices 5 are respectively provided on the left and right sides of the machine body 2, and support the machine body 2 such that the machine body 2 is allowed to travel. That is, a pair of the left and right traveling devices 5 are provided. The traveling devices 5 include crawler traveling devices. Note that the traveling devices 5 are not limited to crawler traveling devices, and may be wheeled traveling devices including front wheel(s) and rear wheel(s), or may be semi-crawler traveling devices in which the front wheels or the rear wheels are crawler wheels.

When the left-side traveling device (left traveling device) 5 and the right-side traveling device (right traveling device) 5 are both driven to rotate forward or both driven to rotate reversely, or when one of them is driven to rotate forward and the other is driven to rotate reversely or is stopped, the machine body 2 (working machine 1) travels forward, travels rearward, or turns left or right. That is, the traveling devices 5 are operable to cause the machine body 2 to travel and turn. Furthermore, as the speed of rotation of the left and right traveling devices 5 changes, the travel speed of the machine body 2 changes, whereas, as the left and right traveling devices 5 stop, the machine body 2 stops. In this way, the traveling devices 5 change the traveling state such as the direction of travel, the travel speed, and the stopping of the machine body 2.

The working device 4 is provided on the machine body 2. The working device 4 includes arms 10, first links 12, second links 13, lift cylinders 14, tilt cylinders 15, a hitch 16, and an attachment 11. Of these, the arms 10, the first links 12, the second links 13, the lift cylinders 14, and the tilt cylinders 15 are provided on the left and the right of the cabin 3. The left and right arms 10 are connected by a connector.

The arms 10 are connected to the machine body 2 swingably in the up-down direction relative to the machine body 2. Specifically, the first links 12 and the second links 13 support proximal portions (rear portions) of the arms 10 via shafts such that the arms 10 are swingable in the up-down direction. First ends of the lift cylinders 14 are rotatably connected to the arms 10 via shafts, and opposite second ends of the lift cylinders 14 are rotatably connected to a lower rear portion of the machine body 2 via shafts. The lift cylinders 14 are hydraulic actuators (first actuators) to cause the arms 10 to swing in the up-down direction by extending and retracting.

The hitch 16 is connected to distal portions of the arms 10 swingably in the up-down direction relative to the distal portion of the arms 10. Specifically, first ends of the tilt cylinders 15 and the distal portions of the arms 10 are respectively rotatably connected to a rear portion of the hitch 16 via shafts. Opposite second ends of the tilt cylinders 15 are rotatably connected to central curved portions of the arms 10 via shafts and brackets. The tilt cylinders 15 are hydraulic actuators (second actuators) to cause the hitch 16 to swing in the up-down direction by extending and retracting. The attachment 11 is attached to the front surface of the hitch 16. The hitch 16 is a linkage to attach and detach the attachment 11 thereto and therefrom.

Figure 13:
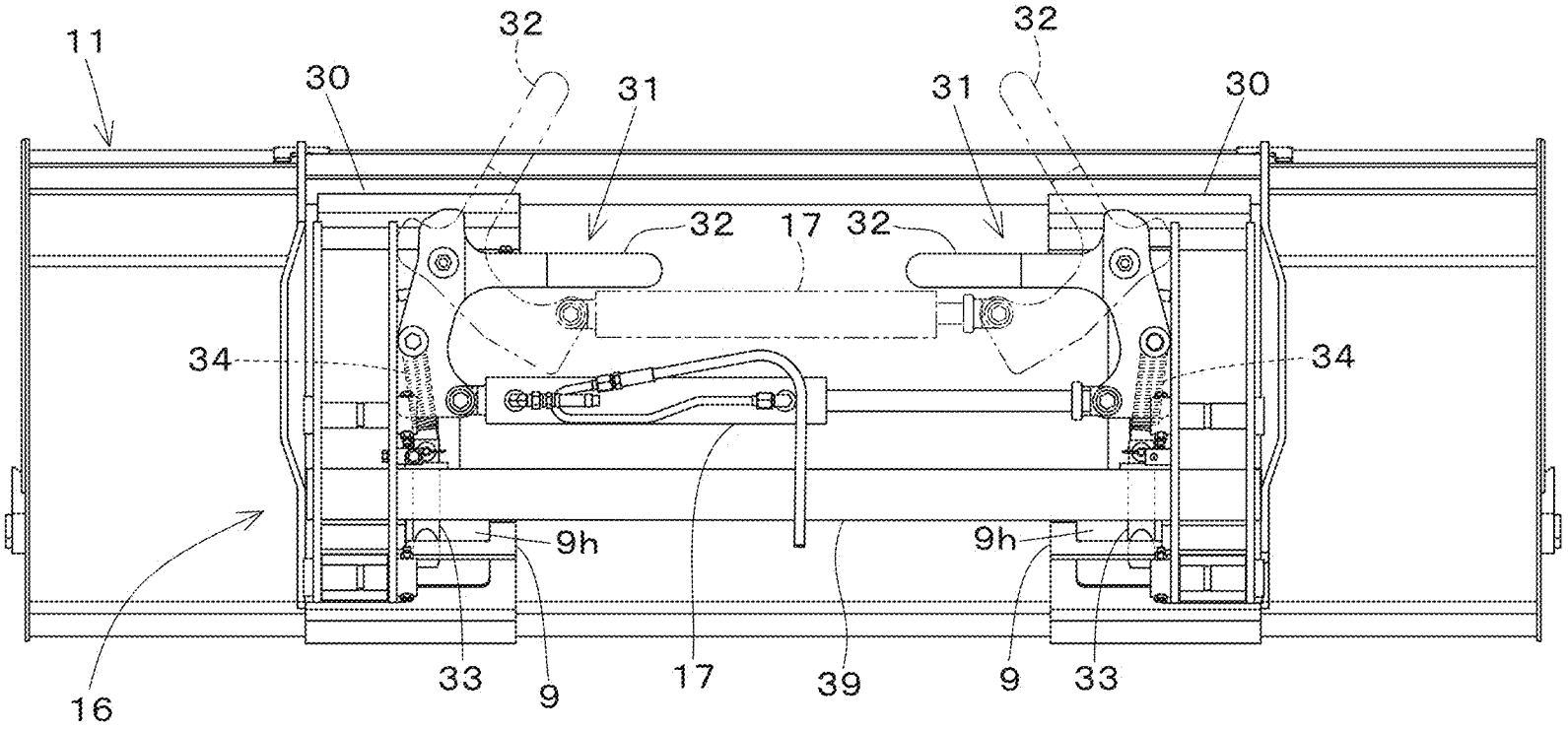
FIG. 13 is an elevational view of a quick hitch.

FIG. 13 is an elevational view of the quick hitch 16. Specifically, FIG. 13 shows the hitch 16 as seen from the machine body 2 of the working machine 1 in FIG. 12. The hitch 16 includes brackets 30, latching mechanisms 31, a latch cylinder 17, and the like. A pair of the left and right brackets 30 and a pair of the left and right latching mechanisms 31 are provided. The left and right brackets 30 are connected by a beam 39. The distal portions of the left and right arms 10 and the first ends of the left and right tilt cylinders 15 are connected to the left and right brackets 30 via shafts (FIG. 12). The left and right latching mechanisms 31 are respectively provided on the left and right brackets 30.

Each latching mechanism 31 includes a latch lever 32, a latch pin 33 and the like. An upper portion of the latch lever 32 is rotatably connected to the corresponding bracket 30 via a shaft. The latch pin 33 is held swingably up and down by the bracket 30. A lower end portion of a coil spring 34 is connected to an upper end portion of the latch pin 33 via a shaft, and an upper end portion of the coil spring 34 is connected to a central portion of the latch lever 32 via a shaft.

The latch cylinder 17 is a hydraulic cylinder (hydraulic actuator) to actuate the latching mechanisms 31 between a latching state and an unlatching state. A first end (distal portion of the rod) of the latch cylinder 17 is rotatably connected to a lower end portion of one of the latch levers 32 via a shaft. An opposite second end (bottom portion of the cylinder case) of the latch cylinder 17 is rotatably connected to a lower end portion of the other the latch levers 32 via a shaft.

As represented by a solid line in FIG. 13, when the latch cylinder 17 extends with the front surfaces of the brackets 30 abutting a base plate 9 connected to the back surface of the attachment 11, the latch levers 32 rotate to descend, causing the latch pins 33 to be inserted into through-holes **9*h* in a lower end portion of the base plate 9. With this, the latching mechanisms 31 are brought into a latching state in which the attachment 11 is secured to the brackets 30 (attached to the hitch 16**).

As represented by a dot-dot-dash line in FIG. 13, when the latch cylinder 17 retracts, the latch levers 32 rotate to ascend, allowing the latch pins 33 to be removed from the through-holes 9*h* of the base plate 9 by the elastic force of the coil springs 34. With this, the latching mechanisms 31 are brought into an unlatching state in which the attachment 11 is not secured to the brackets 30, allowing the attachment 11 to be detached from the hitch 16.

Since the above-described hitch 16 allows the attachment 11 to be easily replaced with another one, the hitch 16 is called a "quick hitch" or "quick changer". Note that another actuator such as a hydraulic motor may be used instead of the latch cylinder 17, or an electric actuator such as an electric motor or an electric cylinder may be used instead of the latch cylinder 17.

When the arms 10 are caused to swing in the up-down direction by the lift cylinders 14 with the attachment 11 attached to the hitch 16 as described above, the attachment 11 is raised or lowered, and the position (height) of the attachment 11 in the up-down direction relative to the machine body 2 and to the target object and the position of the attachment 11 in the front-back direction are changed. When the hitch 16 is caused to swing in the up-down direction by the tilt cylinders 15, the attachment 11 also swings in the up-down direction, and the tilt angle of the attachment 11, i.e., the orientation (which includes the pitch angle relative to the front-rear direction) of the attachment 11 relative to the machine body 2 and the target object, is changed.

Thus, the working device 4 is a posture changing device to change the posture including the position and the orientation of the attachment 11. Furthermore, with regard to the working device 4, since the arms 10 and the hitch 16 are individually swingable, the working device 4 can, when at least one of the arms 10 or the hitch 16 swing(s) with the attachment 11 attached, change the posture including at least one of the height or the orientation of the attachment 11 relative to the machine body 2 and the target object. The attachment 11 is changed between a work posture in which the working device 4 can perform work on a target object and a non-work posture in which the working device 4 does not perform work. The working machine 1 includes a working unit 4U including the working device 4 and the attachment 11 attached to the working device 4.

The working device 4 (hitch 16) is operable to attach thereto and detach therefrom each of attachments 11 to perform various types of work, and a selected one of the attachments 11 is attached to the working device (hitch 16). The attachment 11 is a working tool to perform work. The working machine 1 performs work corresponding to the attachment 11 attached to the working device 4.

Examples of the attachment 11 attachable to the working device 4 include attachments 11 with no actuators and attachments 11 including an actuator. For example, buckets, pallet forks, and the like do not include actuators. For example, sweepers, snow blowers, snow blades, angle brooms, mowers, plows, skid cutters, breakers, earth augers, spreaders, and the like each include an actuator and are driven by power from the actuator. The actuator in or on the attachment 11 is actuated by power from the working machine 1.

For example, spreaders and the like are non-contact work attachments 11 which perform work such as spreading fertilizer or agricultural chemicals while being moved by the working machine 1 without contacting the target object such as earth or crops.

For example, buckets, sweepers, snow blowers, snow blades, angle brooms, hopper brooms, mowers, plows, skid cutters, and the like are contacting/moved work attachments 11 to perform work such as carrying, removing, adjusting, or destroying a target object such as earth, soil, or plants while being moved by the working machine 1 and being kept in contact with the target object. In the example shown in FIG. 12, a sweeper, which is a contacting/moved work attachment 11 including an auxiliary actuator 27, is attached to the working device 4 (hitch 16).

In the case where a contacting/moved work attachment 11 is attached to the working device 4 of the working machine 1, the user, for example, operates the working device 4 to bring the attachment 11 into a work posture in contact with the target object, and then manually operates the working machine 1 to travel to perform work using the attachment 11. Upon the working machine 1 reaching an edge of the worksite, the user manually operates the working device 4 to or causes the working device 4 to automatically bring the attachment 11 into a non-work posture away from the target object, and then manually operates the working machine 1 to turn to change the direction of travel of the working machine 1. Furthermore, the user, after turning the working machine 1 to change the direction of travel, manually operates the working device 4 to or causes the working device 4 to automatically bring the attachment 11 back into the work posture, and then manually operates the working machine 1 to travel and the attachment 11 to resume work.

In the present example embodiment, the actuator(s) provided in or on the drive attachment 11 is a hydraulic actuator such as a hydraulic motor or a hydraulic cylinder. For example, an auxiliary actuator 27 provided in or on the sweeper (attachment) 11 shown in FIG. 12 is a hydraulic motor which drives the sweeper 11.

The auxiliary actuator 27 provided in or on the drive attachment 11 is actuated by hydraulic fluid supplied from the working machine 1. As shown in FIG. 12, the machine body 2 of the working machine 1 is provided with AUX port(s) (auxiliary port(s)) 25 at a front portion thereof. The AUX ports 25 allow hydraulic fluid to flow to and from the auxiliary actuator 27. The AUX ports 25 include a first AUX port 25*a* and a second AUX port 25*b*. The attachment 11 includes a first hydraulic port and a second hydraulic port. Each port includes a coupler.

For example, the user or the like connects an external fluid passage 26*a* including a hose or the like to the first AUX port 25*a* and to the first hydraulic port of the attachment 11, and connects an external fluid passage 26*b* to the second hydraulic port of the attachment 11 and to the second AUX port 25*b*. With this, hydraulic fluid is allowed to flow out (to be supplied) from the working machine 1 to the auxiliary actuator 27 of the attachment 11, and is allowed to flow from the auxiliary actuator 27 into (returns to) the working machine 1. This defines a hydraulic circuit between the working machine 1 and the auxiliary actuator 27, so that the auxiliary actuator 27 can be actuated by hydraulic fluid from the working machine 1 to cause the attachment 11 to perform work. In the example in FIG. 12, the above circuit allows a brush 11*b*, which is a driven portion of the sweeper, to be driven to rotate by power from the auxiliary actuator 27 and to perform work to remove a target object such as dust on a ground J.

As described above, the actuators 14, 15 and 27 provided in or on the working device 4 and the attachment 11 are actuated by hydraulic fluid to cause the working device 4 and the attachment 11 to perform work. Note that some attachments are electric-driven attachments including electric actuator(s) such as an electric motor and/or an electric cylinder. Such an electric-driven attachment performs work in the following manner. Electricity from a battery provided in or on the working machine 1 is inputted into an electric actuator via an electric connector and an electric cable in or on the machine body 2, so that the electric actuator is actuated and the attachment is driven by power from the actuator, making it possible to perform work.

FIG. 1 illustrates a work-related hydraulic circuit 4A included in the working machine 1. This hydraulic circuit 4A causes the working device 4 and the attachment 11 to operate. The working machine 1 includes a pilot pump P1 and a main pump P2. For example, the pilot pump P1 is a fixed displacement hydraulic pump, and the main pump P2 is a variable displacement hydraulic pump.

The pilot pump P1 is actuated by power from the prime mover 6 to deliver hydraulic fluid stored in a hydraulic fluid tank T to a fluid passage 40. The hydraulic fluid delivered by the pilot pump P1 is pilot fluid to control various hydraulic devices provided in the working machine 1. The pressure of pilot fluid is a pilot pressure.

The main pump P2 is actuated by power from the prime mover 6 to deliver hydraulic fluid stored in the hydraulic fluid tank T to a main fluid passage 45. The hydraulic fluid delivered by the main pump P2 is used to actuate the lift cylinders 14 and the tilt cylinders 15 of the working device 4, as well as hydraulic device(s) such as the auxiliary actuator 27 provided in or on the attachment 11.

The working machine 1 includes a plurality of control valves 60A, 60B and 60C. The plurality of control valves 60A, 60B and 60C include a lift control valve 60A, a tilt control valve 60B, and an auxiliary (AUX) control valve 60C. The plurality of control valves 60 are each connected to the main fluid passage 45. The lift control valve 60A controls the flow rate (output) and the supply direction of hydraulic fluid supplied from the main fluid passage 45 to the lift cylinders 14 to actuate the lift cylinders 14. The tilt control valve 60B controls the flow rate (output) and the supply direction of hydraulic fluid supplied from the main fluid passage 45 to the tilt cylinders 15 to actuate the tilt cylinders 15. The AUX control valve 60C controls the flow rate and the supply direction of the hydraulic fluid supplied from the main fluid passage 45 to the auxiliary actuator 27 via the AUX port(s) 25 to actuate the auxiliary actuator 27.

The lift control valve 60A is connected to the lift cylinders 14 via a plurality of fluid passages 64*a* and 64*b*. The lift control valve 60A is a pilot-operated, direct-acting spool three-position switching valve. The lift control valve 60A includes a plurality of work pressure receivers 61*a* and 61*b*, and switches between a third position (neutral position) 61*c*, a first position 61*d* different from the third position 61*c*, and a second position 61*e* different from the third position 61*c* and the first position 61*d* depending on the pilot pressure acting on the work pressure receiver(s) 61*a* and/or 61*b*. When the lift control valve 60A is in the third position 61*c*, hydraulic fluid is not supplied from the main fluid passage 45 to the lift cylinders 14.

When the lift control valve 60A switches to the first position 61*d* or the second position 61*e*, hydraulic fluid from the main fluid passage 45 is supplied to the lift cylinders 14 via the lift control valve 60A and the fluid passage 64*a* or 64*b*. When the opening of the lift control valve 60A changes according to the pilot pressure while the lift control valve 60A is in the first position 61*d* or the second position 61*e*, the flow rate of hydraulic fluid from the main fluid passage 45 to the lift cylinders 14 is changed. Thus, the lift control valve 60A controls the supply direction and the flow rate of hydraulic fluid supplied from the main fluid passage 45 to the lift cylinders 14 according to the pilot pressure acting on the work pressure receiver(s) 61*a* and/or 61*b* to cause the lift cylinders 14 to extend or retract.

More specifically, when the lift control valve 60A switches to the first position 61*d*, hydraulic fluid from the main fluid passage 45 flows through the lift control valve 60A and the fluid passage 64*a* and is supplied to the rod-side chambers of the lift cylinders 14. With this, the lift cylinders 14 retract, the arms 10 swing downward, and the attachment 11 attached to the hitch 16 lowers. The hydraulic fluid pushed out of the cap-side chambers of the lift cylinders 14 flows through the fluid passage 64*b* and is drained from the lift control valve 60A.

When the lift control valve 60A switches to the second position 61*e*, hydraulic fluid from the main fluid passage 45 flows through the lift control valve 60A and the fluid passage 64*b*, and is supplied to the cap-side chambers of the lift cylinders 14. With this, the lift cylinders 14 extend, the arms 10 swing upward, and the attachment 11 attached to the hitch 16 is raised. The hydraulic fluid pushed out from the rod-side chambers of the lift cylinders 14 flows through the fluid passage 64*a* and is drained from the lift control valve 60A.

The tilt control valve 60B is connected to the tilt cylinders 15 by a plurality of fluid passages 65*a* and 65*b*. The tilt control valve 60B is a pilot-operated, direct-acting spool three-way switching valve. The tilt control valve 60B includes a plurality of work pressure receivers 62*a* and 62*b*, and switches between a third position (neutral position) 62*c*, a first position 62*d* different from the third position 62*c*, and a second position 62*e* different from the third position 62*c* and the first position 62*d*, depending on the pilot pressure acting on the work pressure receiver(s) 62*a* and/or 62*b*. When the tilt control valve 60B is in the third position 62*c*, hydraulic fluid is not supplied from the main fluid passage 45 to the tilt cylinders 15.

The tilt control valve 60B switches to the first position 62*d* or the second position 62*e* to allow hydraulic fluid from the main fluid passage 45 to be supplied to the tilt cylinders 15 via the tilt control valve 60B and the fluid passage 65*a* or 65*b*. When the opening of the tilt control valve 60B changes according to the pilot pressure while the tilt control valve 60B is in the first position 62*d* or the second position 62*e*, the flow rate of hydraulic fluid from the main fluid passage 45 to the tilt cylinders 15 is changed. Thus, the tilt control valve 60B controls the supply direction and the flow rate of hydraulic fluid supplied from the main fluid passage 45 to the tilt cylinders 15 according to the pilot pressure acting on the work pressure receiver(s) 62*a* and/or 62*b* to cause the tilt cylinders 15 to extend or retract.

More specifically, when the tilt control valve 60B switches to the first position 62*d*, hydraulic fluid from the main fluid passage 45 flows through the tilt control valve 60B and the fluid passage 65*b*, and is supplied to the cap-side chambers of the tilt cylinders 15. With this, the tilt cylinders 15 extend, the hitch 16 swings downward, the tilt angle of the attachment 11 attached to the hitch 16 decreases, and the orientation is changed such that the front portion of the attachment 11 lowers. The hydraulic fluid pushed out of the rod-side chambers of the tilt cylinders 15 flows through the fluid passage 65*b* and is drained from the tilt control valve 60B.

When the tilt control valve 60B switches to the second position 62*e*, hydraulic fluid from the main fluid passage 45 flows through the tilt control valve 60B and the fluid passage 65*a*, and is supplied to the rod-side chambers of the tilt cylinders 15. With this, the tilt cylinders 15 retract, the hitch 16 swings upward, the tilt angle of the attachment 11 attached to the hitch 16 increases, and the orientation is changed such that the front portion of the attachment 11 is raised. The hydraulic fluid pushed out from the cap-side chambers of the tilt cylinders 15 flows through the fluid passage 65*a* and is drained from the tilt control valve 60B.

The AUX control valve 60C is connected to the AUX ports 25 via a plurality of AUX fluid passages (auxiliary fluid passages) 66*a* and 66*b*. Specifically, a first port of the AUX control valve 60C and the first AUX port 25*a* are connected via the AUX fluid passage 66*a*, and a second port of the AUX control valve 60C and the second AUX port 25*b* are connected via the AUX fluid passage 66*b*. The AUX control valve 60C is a pilot-operated, direct-acting spool three-position switching valve. The AUX control valve 60C includes a plurality of AUX pressure receivers 63*a* and 63*b*, and switches between a third position (neutral position) 63*c*, a first position 63*d* different from the third position 63*c*, and a second position 63*e* different from the third position 63*c* and the first position 63*d*, depending on the pilot pressure acting on the AUX pressure receiver(s) 63*a* and/or 63*b*.

When the AUX control valve 60C is in the third position 63*c*, hydraulic fluid is not supplied to the auxiliary actuator 27 from the main fluid passage 45 via the AUX fluid passage 66*a* or 66*b* and the AUX port(s) 25. When the AUX control valve 60C switches to the first position 63*d* or the second position 63*e*, hydraulic fluid from the main fluid passage 45 is supplied to the auxiliary actuator 27 via the AUX control valve 60C, the AUX fluid passage 66*a* or 66*b*, and the corresponding AUX port 25, and the supply direction of the hydraulic fluid changes.

More specifically, when the AUX control valve 60C switches to the first position 63*d*, hydraulic fluid from the main fluid passage 45 is supplied to the auxiliary actuator 27 via the AUX control valve 60C, the AUX fluid passage 66*a* and the first AUX port 25*a*, and return fluid from the auxiliary actuator 27 flows through the second AUX port 25*b* and the AUX fluid passage 66*b* and is drained from the AUX control valve 60C. When the AUX control valve 60C switches to the second position 63*e*, hydraulic fluid from the main fluid passage 45 is supplied to the auxiliary actuator 27 via the AUX control valve 60C, the AUX fluid passage 66*b* and the second AUX port 25*b*, and return fluid from the auxiliary actuator 27 flows through the first AUX port 25*a* and the AUX fluid passage 66*a* and is drained from the AUX control valve 60C.

When the opening of the AUX control valve 60C changes according to the pilot pressure while the AUX control valve 60C is in the first position 63*d* or the second position 63*e*, the flow rate of hydraulic fluid supplied from the main fluid passage 45 to the auxiliary actuator 27 via the corresponding AUX port 25 is changed.

As described above, the AUX control valve 60C controls the supply direction and the flow rate of hydraulic fluid supplied from the main fluid passage 45 to the auxiliary actuator 27 via the corresponding AUX fluid passage 66*a* or 66*b* and the corresponding AUX port 25 according to the pilot pressure acting on the AUX pressure receiver(s) 63*a* and/or 63*b* to actuate the auxiliary actuator 27. The AUX control valve 60C, the AUX fluid passages 66*a* and 66*b*, and the AUX ports 25 define an auxiliary hydraulic circuit (power output circuit) 4B to supply (output) hydraulic fluid (i.e., power) to the auxiliary actuator 27 of the attachment 11, and the auxiliary hydraulic circuit 4B is provided in the working machine 1.

The working machine 1 includes pressure detectors 70*a* and 70*b*. The pressure detectors 70*a* and 70*b* include pressure sensors. The pressure detector 70*a* is provided in the AUX fluid passage 66*a* to detect an AUX pressure (auxiliary pressure) which is the pressure of hydraulic fluid flowing from the AUX control valve 60C through the AUX fluid passage 66*a* and is supplied to the auxiliary actuator 27 of the attachment 11. The pressure detector 70*b* is provided in the AUX fluid passage 66*b* to detect an AUX pressure which is the pressure of hydraulic fluid flowing from the AUX control valve 60C through the AUX fluid passage 66*b* and is supplied to the auxiliary actuator 27. During work performed by the attachment 11 including the auxiliary actuator 27, the AUX pressure detected by the pressure detector(s) 70*a* and/or 70*b* can be regarded as a load on the attachment 11.

Note that the pressure detectors 70*a* and 70*b* also detect the pressure of hydraulic fluid (return fluid) flowing from the auxiliary actuator 27 through the corresponding AUX fluid passage 66*a* or 66*b* and returning to the AUX control valve 60C. However, since the pressure is equal to or substantially equal to the atmospheric pressure, the pressure is not regarded as auxiliary pressure by a controller 20.

The working machine 1 includes a plurality of solenoid valves 76*a*, 76*b*, 77*a*, 77*b*, 78*a* and 78*b*. The plurality of solenoid valves 76*a*, 76*b*, 77*a*, 77*b*, 78*a* and 78*b* are proportional valves in each of which the solenoid is energized and the opening is changed according to a control signal (electric current signal) inputted thereto. The plurality of solenoid valves 76*a*, 76*b*, 77*a*, 77*b*, 78*a* and 78*b* are each connected to fluid passages 40*b* and 40*c* branching from the fluid discharge passage 40, and a change in the opening thereof changes the pilot pressure of pilot fluid supplied from the fluid discharge passage 40. Specifically, as the electric current value of the control signal inputted increases, the opening of the plurality of solenoid valves 76*a*, 76*b*, 77*a*, 77*b*, 78*a* and 78*b* increases, allowing pilot fluid from the fluid discharge passage 40 to be outputted with an increased pilot pressure.

The plurality of solenoid valves 76*a*, 76*b*, 77*a*, 77*b*, 78*a* and 78*b* include lift solenoid valves 76*a* and 76*b*, tilt solenoid valves 77*a* and 77*b*, and AUX solenoid valves 78*a* and 78*b*. The lift solenoid valves 76*a* and 76*b* are respectively connected to the work pressure receivers 61*a* and 61*b* of the lift control valve 60A via fluid passages. The tilt solenoid valves 77*a* and 77*b* are respectively connected to the work pressure receivers 62*a* and 62*b* of the tilt control valve 60B via fluid passages. The AUX solenoid valves 78*a* and 78*b* are respectively connected to the AUX pressure receivers 63*a* and 63*b* of the AUX control valve 60C via fluid passages.

When the opening of the lift solenoid valve 76*a* is greater than 0 (zero), pilot fluid from the fluid discharge passage 40 acts on the work pressure receiver 61*a* from the lift solenoid valve 76*a*. In so doing, a pilot pressure corresponding to the opening of the lift solenoid valve 76*a* acts on the work pressure receiver 61*a*. When the pilot pressure acting on the work pressure receiver 61*a* is equal to or higher than a predetermined value, the spool of the lift control valve 60A moves, and the lift control valve 60A switches to the first position 61*d*. With this, the lift cylinders 14 retract and the attachment 11 lowers, and therefore the lift solenoid valve 76*a* is a solenoid valve to lower the attachment.

Similarly, when the opening of the lift solenoid valve 76*b* increases, pilot fluid from the fluid discharge passage 40 acts on the work pressure receiver 61*b* from the lift solenoid valve 76*b*, and the lift control valve 60A switches to the second position 61*e*. With this, the lift cylinders 14 extend and the attachment 11 is raised, and therefore the lift solenoid valve 76*b* is a solenoid valve to raise the attachment.

Similarly, when the opening of the tilt solenoid valve 77*a* increases, pilot fluid from the fluid discharge passage 40 acts on the work pressure receiver 62*a* from the tilt solenoid valve 77*a*, and the tilt control valve 60B switches to the first position 62*d*. With this, the tilt cylinders 15 extend and the tilt angle of the attachment 11 decreases, and therefore the tilt solenoid valve 77*a* is a solenoid valve to lower the front portion of the attachment. When the opening of the tilt solenoid valve 77*b* increases, pilot fluid from the fluid discharge passage 40 acts on the work pressure receiver 62*b* from the tilt solenoid valve 77*b*, and the tilt control valve 60B switches to the second position 62*e*. With this, the tilt cylinders 15 retract and the tilt angle of the attachment 11 increases, and therefore the tilt solenoid valve 77*b* is a solenoid valve to raise the front portion of the attachment.

Similarly, when the opening of the AUX solenoid valve 78*a* increases, pilot fluid from the fluid discharge passage 40 acts on the AUX pressure receiver 63*a* via the AUX solenoid valve 78*a*, and the AUX control valve 60C switches to the first position 63*d*. With this, hydraulic fluid is supplied from the AUX control valve 60C to the auxiliary actuator 27 via the AUX fluid passage 66*a* and the first AUX port 25*a*. When the opening of the AUX solenoid valve 78*b* increases, pilot fluid from the fluid discharge passage 40 acts on the AUX pressure receiver 63*b* via the AUX solenoid valve 78*b*, and the AUX control valve 60C switches to the second position 63*e*. With this, hydraulic fluid is supplied from the AUX control valve 60C to the auxiliary actuator 27 via the AUX fluid passage 66*b* and the second AUX port 25*b*.

The plurality of solenoid valves 76*a*, 76*b*, 77*a*, 77*b*, 78*a* and 78*b* change the pilot pressure to act on the corresponding pressure receivers 61*a*, 61*b*, 62*a*, 62*b*, 63*a* and 63*b* according to the control signals inputted thereto to change the flow rate of hydraulic fluid from the corresponding control valves 60A, 60B and 60C to the corresponding actuators 14, 15 and 27.

The working machine 1 includes a work manual operator (work manual operator unit) 67 and the controller 20. The work manual operator 67 is a manual operator to be operated to actuate the working device 4 to cause the working device 4 to freely change the posture of the attachment 11, and to control the swinging of the arms 10 and the hitch 16. The work manual operator 67 includes a digital joystick. The work manual operator 67 includes a work operating lever 67*a* and a sensor 67*b*. The work operating lever 67*a* is a manual operator (work manual operator) to be operated by the driver of the working machine, and is provided in the vicinity of the seat 8 inside the cabin 3. The work operating lever 67*a* can be operated not only forward and rearward from a neutral position, but also leftward and rightward from the neutral position.

The sensor 67*b* includes at least one of an angle sensor or an electric circuit, detects the operation direction and the operation angle (angle of pivoting) of the work operating lever 67*a*, and outputs a detection signal (electric signal) corresponding to the operation direction and the operation angle. The controller 20 determines the operation direction and the operation angle of the work operating lever 67*a* based on the detection signal outputted from the sensor 67*b*, and calculates the ratio of the operation angle to the maximum angle of pivoting of the work operating lever 67*a* as the operation amount of the work operating lever 67*a*.

The controller 20 then inputs a control signal into the lift solenoid valve 76*a* or 76*b* or the tilt solenoid valve 77*a* or 77*b* according to the operation direction and the operation amount of the work operating lever 67*a* to open the solenoid valve. With this, a corresponding one of the lift control valve 60A and the tilt control valve 60B switches to the first position 61*d*, 62*d* or the second position 61*e*, 62*e*, the lift cylinders 14 or the tilt cylinders 15 extend or retract, the arms 10 or the hitch 16 swing(s) in the corresponding direction, and the position including the height or the orientation (tilt angle) of the attachment 11 attached to the hitch 16 is changed.

Specifically, when the work operating lever 67*a* is pivoted forward, the controller 20 inputs a control signal into the lift solenoid valve 76*a* according to the operation amount of the work operating lever 67 to open the lift solenoid valve 76*a*. With this, the lift control valve 60A switches to the first position 61*d*, the lift cylinders 14 retract, the arms 10 swing downward, the attachment 11 lowers, and the height of the attachment 11 decreases. In so doing, the attachment 11 is positioned somewhat forward.

When the work operating lever 67*a* is pivoted rearward, the controller 20 inputs a control signal into the lift solenoid valve 76*b* according to the operation amount of the work operating lever 67*a* to open the lift solenoid valve 76*b*. With this, the lift control valve 60A switches to the second position 61*e*, the lift cylinders 14 extend, the arms 10 swing upward, the attachment 11 is raised, and the height of the attachment 11 increases. In so doing, the attachment 11 is positioned somewhat rearward.

When the work operating lever 67*a* is pivoted leftward, the controller 20 inputs a control signal into the tilt solenoid valve 77*a* according to the operation amount of the work operating lever 67*a* to open the tilt solenoid valve 77*a*. With this, the tilt control valve 60B switches to the first position 62*d*, the tilt cylinders 15 extend, and the hitch 16 swings downward, so that the orientation of the attachment 11 is changed such that the front portion of the attachment 11 lowers.

When the work operating lever 67*a* is pivoted rightward, the controller 20 inputs a control signal into the tilt solenoid valve 77*b* according to the operation amount of the work operating lever 67*a* to open the tilt solenoid valve 77*b*. With this, the tilt control valve 60B switches to the second position 62*e*, the tilt cylinders 15 retract, the hitch 16 swings upward, so that the orientation of the attachment 11 is changed such that the front portion of the attachment 11 is raised.

Note that when the controller 20 causes the arms 10 to swing, the controller 20 causes the hitch 16 to swing so that the orientation of the attachment 11 is not changed, in some cases. That is, the controller 20, when causing the arms 10 to swing by inputting a control signal into one of the lift solenoid valves 76*a* and 76*b*, the controller 20 also inputs a control signal into a corresponding one of the tilt solenoid valves 77*a* and 77*b* that corresponds to the swinging direction of the arms 10 to cause the hitch 16 to swing, thus keeping the orientation of the attachment 11 constant. This eliminates or reduces the likelihood that, when the arms 10 swing, the attachment 11 will tilt and accidentally contact a target object or surrounding objects and be damaged. As described above, the controller 20 controls actuation of the working device 4 in response to manual operation of the work manual operator 67 (work operating lever 67*a*). The controller 20 also automatically controls actuation of the working device 4.

The working machine 1 includes an AUX output switch 73*b*. The AUX output switch 73*b* is an operating switch to be operated by the driver. The AUX output switch 73*b* is turned ON to start supplying hydraulic fluid to the corresponding AUX port 25, and is turned OFF to stop supplying the hydraulic fluid.

When the controller 20 is in an AUX mode in which the attachment 11 including the auxiliary actuator 27 is allowed to be used with the working machine 1, if the AUX output switch 73*b* is turned ON, the controller 20 inputs a control signal into one of the AUX solenoid valves 78*a* and 78*b* to open the solenoid valve. With this, the AUX control valve 60C switches to the first position 63*d* or the second position 63*e*, and hydraulic fluid is supplied from the AUX control valve 60C to the corresponding AUX port 25 via the AUX fluid passage 66*a* or the AUX fluid passage 66*b*. In so doing, if the AUX ports 25 and hydraulic ports of the attachment 11 are connected by the external fluid passages 26, hydraulic fluid is supplied from the corresponding AUX port 25 to the auxiliary actuator 27 of the attachment 11 via the corresponding external fluid passage 26 and the like, the auxiliary actuator 27 is actuated, and the attachment 11 is driven.

When the controller 20 is in the AUX mode, if the AUX output switch 73*b* is turned OFF, the controller 20 stops inputting the control signal into the AUX solenoid valve 78*a* or 78*b* to close the AUX solenoid valve 78*a* or 78*b*. With this, the AUX control valve 60C switches to the third position 63*c*, and the supply of hydraulic fluid from the AUX control valve 60C to the AUX port 25 is stopped. Thus, the supply of hydraulic fluid to the auxiliary actuator 27 of the attachment 11 is also stopped, the auxiliary actuator 27 stops, and the attachment 11 stops.

The controller 20 inputs a control signal into at least one of the lift solenoid valve 76*b* or 76*b* or the tilt solenoid valve 77*a* or 77*b* according to the AUX pressure detected by the pressure detectors 70*a* and 70*b* to adjust the opening of the solenoid valve(s). With this, the controller 20 switches at least one of the lift control valve 60A or the tilt control valve 60B to the first position or the second position to supply hydraulic fluid to at least one of the lift cylinders 14 or the tilt cylinders 15 to cause the cylinders to extend or retract to cause at least one of the arms 10 or the hitch 16 to swing, thus adjusting at least one of the position or the orientation of the attachment 11.

The working machine 1 includes a load sensing system (which may be hereinafter simply referred to as "LS system") 80. The LS system 80 is a hydraulic system to control the flow rate of hydraulic fluid delivered by the variable displacement main pump P2 such that a differential pressure is constant. The differential pressure is obtained by subtracting, from the hydraulic fluid delivery pressure of the main pump P2 which is a variable displacement pump, the maximum of load pressures on the actuators 14, 15 and 27 actuated by hydraulic fluid delivered by the main pump P2.

The LS system 80 includes a swash plate changing cylinder 81, a flow rate compensation valve 82, and an opening changing cylinder 83. The swash plate changing cylinder 81 adjusts the angle of the swash plate of the main pump P2. The flow rate compensation valve 82 causes a hydraulic pressure to act on the swash plate changing cylinder 81 to actuate the swash plate changing cylinder 81. The opening changing cylinder 83 is actuated by the pilot pressure of pilot fluid from the pilot pump P1 to change the opening of the flow rate compensation valve 82.

A PLS fluid passage 84 and a PPS fluid passage 85 are connected to the flow rate compensation valve 82. The PLS fluid passage 84 is a fluid passage to transmit a PLS pressure which is the maximum of the load pressures on the actuators 14, 15 and 27 (actuator maximum load pressure). The PPS fluid passage 85 is used to transmit a PPS pressure which is the delivery pressure of the main pump P2. The flow rate compensation valve 82 actuates the swash plate changing cylinder 81 to adjust the angle of the swash plate of the main pump P2 such that the differential pressure, which is obtained by subtracting the PLS pressure from the PPS pressure, is constant. With this, the flow rate of hydraulic fluid delivered by the main pump P2 is controlled, and hydraulic power corresponding to the load applied to the working device 4 and the attachment 11 is outputted from the main pump P2.

In the present example embodiment, the swash plate of the main pump P2 is pressed by the self-pressure thereof in a direction that increases the flow rate of hydraulic delivered by the main pump P2. The swash plate changing cylinder 81 is operable to cause a force against the self-pressure of the main pump P2 to act on the swash plate. Furthermore, the flow rate compensation valve 82 is operable to control the delivery flow rate of the main pump P2 by adjusting the hydraulic pressure acting on the swash plate changing cylinder 81. Thus, when the hydraulic pressure acting on the swash plate changing cylinder 81 is removed (becomes zero), the angle of the swash plate of the main pump P2 becomes maximum, and the flow rate of hydraulic fluid delivered by the main pump P2 becomes maximum.

Figure 2:
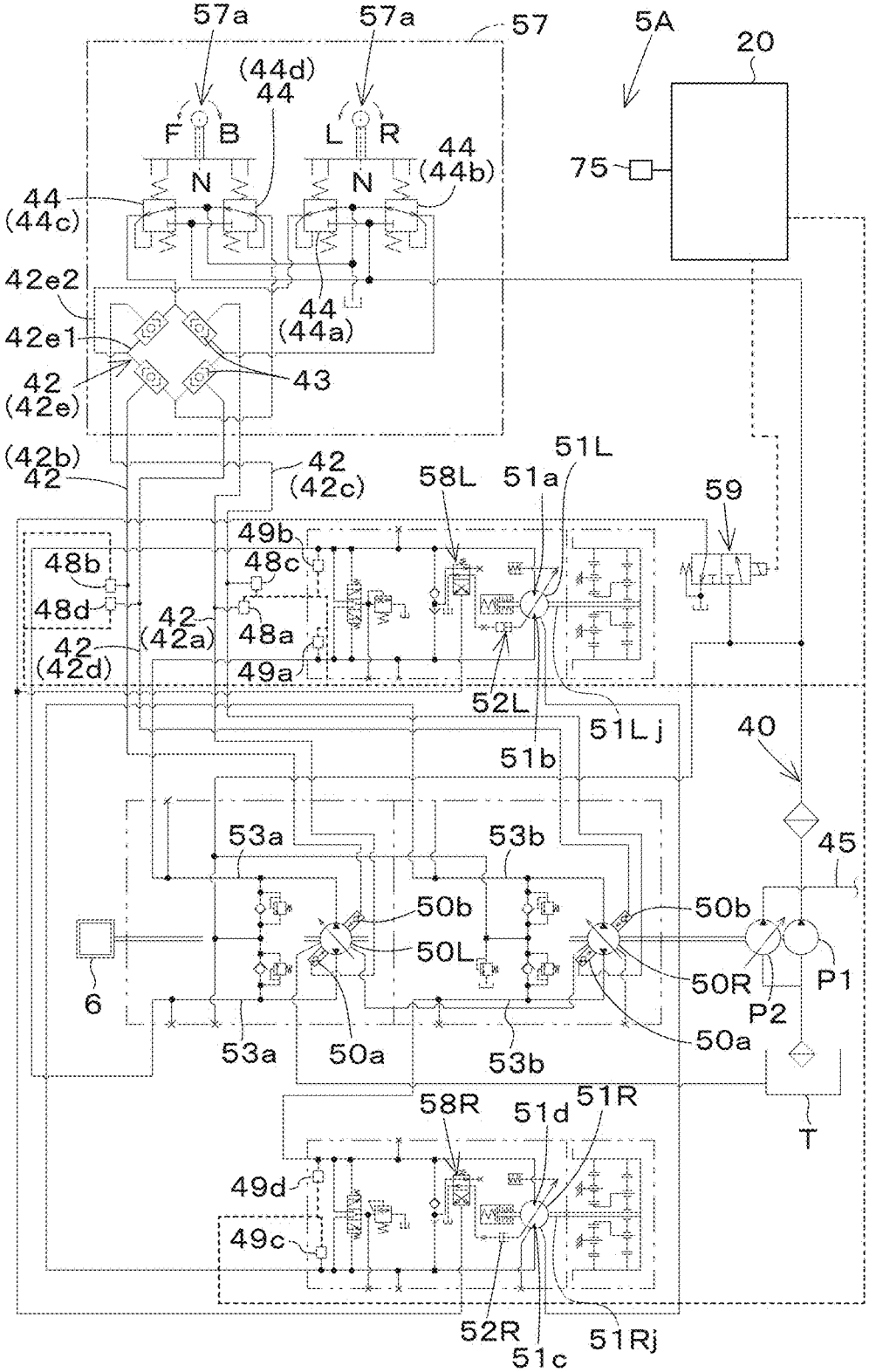
FIG. 2 illustrates an example of a travel-related hydraulic circuit of a working machine.

FIG. 2 illustrates a travel-related hydraulic circuit 5A included in the working machine 1. The hydraulic circuit 5A actuates the traveling devices 5 to cause the working machine 1 to travel. The working machine 1 includes travel pumps 50 and travel motors 51.

Each travel pump 50 is a hydraulic pump to be actuated by power from the prime mover 6. The travel pump 50 is a swash-plate variable displacement axial pump and includes pressure receivers 50*a* and 50*b* to receive pilot pressure. The pump pressure receivers 50*a* and 50*b* include a forward-travel pump pressure receiver 50*a* and a rearward-travel pump pressure receiver 50*b*. The angle of the swash plate of the travel pump 50 is changed according to the pilot pressure acting on the pump pressure receiver(s) 50*a* and/or 50*b*. When the angle of the swash plate of the travel pump 50 is changed, the flow rate and the supply direction of the hydraulic fluid delivered by the travel pump 50 change. The travel pumps 50 include a first travel pump 50L corresponding to the first traveling device 5, and a second travel pump 50R corresponding to the second traveling device 5.

Each travel motor 51 is a hydraulic motor to be actuated by hydraulic fluid delivered by the corresponding travel pump 50. The travel motors 51 include a first travel motor 51L corresponding to the first travel pump 50L, and a second travel motor 51R corresponding to the second travel pump 50R.

The first travel motor 51L is connected to the first travel pump 50L via a closed loop circuit fluid passage 53*a*. The first travel motor 51L is actuated by hydraulic fluid supplied from the first travel pump 50L. The first travel motor 51L includes an output shaft 51Lj, and changes the rotation speed of the output shaft 51Lj based on the flow rate of hydraulic fluid delivered by the first travel pump 50L. When the power from the first travel motor 51L is transmitted from the output shaft 51Lj to the drive shaft of the first traveling device 5 via a transmission mechanism, the first traveling device 5 is driven.

The first travel motor 51L includes a swash plate. When the angle of the swash plate of the first travel motor 51L is changed by a swash plate cylinder 52L, the first travel motor 51L changes the rotation speed stage of the output shaft 51Lj to a first speed stage (low speed stage) or a second speed stage (high speed stage) higher than the first speed stage. Specifically, when the swash plate cylinder 52L retracts, the rotation speed of the output shaft 51Lj of the first travel motor 51L is set to the first speed stage. When the swash plate cylinder 52L extends, the rotation speed of the output shaft 51Lj of the first travel motor 51L is set to the second speed stage.

The second travel motor 51R is connected to the second travel pump 50R via a closed loop circuit fluid passage 53*b*. The second travel motor 51R is actuated by hydraulic fluid delivered by the second travel pump 50R to drive the second traveling device 5 via an output shaft 51Rj and the like. When the angle of the swash plate of the second travel motor 51R is changed by a swash plate cylinder 52R, the second travel motor 51R changes the rotation speed stage of the output shaft 51Rj to the first speed stage or the second speed stage. Since the configurations of the second travel motor 51R, the second travel pump 50R, the second traveling device 5 and the swash plate cylinder 52R are respectively the same as the configurations of the first travel motor 51L, the first travel pump 50L, the first traveling device 5 and the swash plate cylinder 52L, detailed description therefor is omitted.

The working machine 1 includes a travel manual operator (travel manual operator unit) 57. The travel manual operator 57 is operated to control the travel pumps 50, the travel motors 51, and the traveling devices 5. The travel manual operator 57 is operable to be operated to cause the traveling devices 5 and the like to cause the machine body 2 to travel and turn. The travel manual operator 57 is operable to change the pilot pressure applied to the pump pressure receivers 50*a*, 50*b* of the travel pumps 50 to change the angle of swash plates of the travel pumps 50 to change the amount and direction of hydraulic fluid delivered by the travel pumps 50, the speed and direction of rotation of the output shafts 51Lj, 51Rj of the travel motors 51, and the speed and direction of operation of the traveling devices 5. The travel manual operator 57 includes a travel operating lever 57*a* and a plurality of operating valves 44.

The travel operating lever 57*a* is a manual operator (travel manual operator) to be operated by the driver, and is provided in the vicinity of the seat 8 inside the cabin 3. The travel operating lever 57*a* can be operated from the neutral position in a forward direction F, a rearward direction B, a leftward direction L, and a rightward direction R, as well as from the neutral position diagonally leftward and forward, diagonally rightward and forward, diagonally leftward and rearward, and diagonally rightward and rearward.

The operating valves 44 include operating valves 44*a*, 44*b*, 44*c*, and 44*d*. The operating valves 44*a* to 44*d* are connected to a fluid discharge passage 40, and are actuated by operation of the common travel operating lever 57*a* to change the pilot pressure of pilot fluid which is hydraulic fluid supplied from the fluid discharge passage 40.

Specifically, the first operating valve 44*a* is operable to, when the travel operating lever 57*a* is pivoted in the forward direction F, change the pilot pressure outputted therefrom according to the operation amount (angle of pivoting). The second operating valve 44*b* is operable to, when the travel operating lever 57*a* is pivoted in the rearward direction B, change the pilot pressure outputted therefrom according to the operation amount. The third operating valve 44*c* is operable to, when the travel operating lever 57*a* is pivoted in the leftward direction L, change the pilot pressure outputted therefrom according to the operation amount. The fourth operating valve 44*d* is operable to, when the travel operating lever 57*a* is pivoted in the rightward direction R, change the pilot pressure outputted therefrom according to the operation amount.

The operating valves 44 are connected to their corresponding travel pumps 50 by travel fluid passages 42. The travel fluid passages 42 include a first travel fluid passage 42*a*, a second travel fluid passage 42*b*, a third travel fluid passage 42*c*, a fourth travel fluid passage 42*d*, and a fifth travel fluid passage 42*e*. The first travel fluid passage 42*a* is connected to a forward-travel pump pressure receiver 50*a* of the first travel pump 50L. The second travel fluid passage 42*b* is connected to a rearward-travel pump pressure receiver 50*b* of the first travel pump 50L. The third travel fluid passage 42*c* is connected to a forward-travel pump pressure receiver 50*a* of the second travel pump 50R. The fourth travel fluid passage 42*d* is connected to a rearward-travel pump pressure receiver 50*b* of the second travel pump 50R.

The fifth travel fluid passage 42*e* is connected to the operating valves 44*a* to 44*d* and to the travel fluid passages 42*a* to 42*d*. Specifically, the fifth travel fluid passage 42*e* includes a bridge fluid passage 42*e*1 and a plurality of connector fluid passages 45*e*2. In the bridge fluid passage 42*e*1, a plurality of shuttle valves 43 and first ends of the connector fluid passages 45*e*2 are connected alternately. The second ends of the connector fluid passages 45*e*2 are connected to the respective operating valves 44. The shuttle valves 43 are connected to the respective travel fluid passages 42.

When the travel operating lever 57*a* is pivoted in the forward direction F, the first operating valve 44*a* is operated to allow pilot fluid to be supplied from the first operating valve 44*a* to the fifth travel fluid passage 42*e*. The pilot pressure of pilot fluid supplied from the first operating valve 44*a* is applied to the forward-travel pump pressure receiver 50*a* of the first travel pump 50L via the fifth travel fluid passage 42*e* and the first travel fluid passage 42*a*. The pilot pressure from the first operating valve 44*a* is applied to the forward-travel pump pressure receiver 50*a* of the second travel pump 50R via the fifth travel fluid passage 42*e* and the third travel fluid passage 42*c*.

With this, the angle of the swash plates of the first travel pump 50L and the second travel pump 50R is changed, hydraulic fluid delivered by the first travel pump 50L flows through the circuit fluid passage 53*a* and is supplied through the first port 51*a* to the first travel motor 51L, and hydraulic fluid delivered by the second travel pump 50R flows through the circuit fluid passage 53*b* and is supplied through the third port 51*c* to the second travel motor 51R. Then, the output shafts 51Lj, 51Rj of the first travel motor 51L and the second travel motor 51R rotate in the normal direction (rotate to achieve forward travel), the first traveling device 5 and the second traveling device 5 are driven to achieve forward travel, and the working machine 1 travels straight forward.

When the travel operating lever 57*a* is pivoted in the rearward direction B, the second operating valve 44*b* is operated to allow pilot fluid to be supplied from the second operating valve 44*b* to the fifth travel fluid passage 42*e*. The pilot pressure of pilot fluid supplied from the second operating valve 44*b* is applied to the rearward-travel pump pressure receiver 50*b* of the first travel pump 50L via the fifth travel fluid passage 42*e* and the second travel fluid passage 42*b*. The pilot pressure from the second operating valve 44*b* is applied to the rearward-travel pump pressure receiver 50*b* of the second travel pump 50R via the fifth travel fluid passage 42*e* and the fourth travel fluid passage 42*d*.

With this, the angle of the swash plates of the first travel pump 50L and the second travel pump 50R is changed, hydraulic fluid delivered by the first travel pump 50L flows through the circuit fluid passage 53*a* and is supplied through the second port 51*b* to the first travel motor 51L, and hydraulic fluid delivered by the second travel pump 50R flows through the circuit fluid passage 53*b* and is supplied through the fourth port 51*d* to the second travel motor 51R. Then, the output shafts 51Lj, 51Rj of the first travel motor 51L and the second travel motor 51R rotate in the reverse direction (rotate to achieve rearward travel), the first traveling device 5 and the second traveling device 5 are driven to achieve rearward travel, and the working machine 1 travels straight rearward.

When the travel operating lever 57*a* is pivoted in the leftward direction L, the third operating valve 44*c* is operated to allow pilot fluid to be supplied from the third operating valve 44*c* to the fifth travel fluid passage 42*e*. The pilot pressure of pilot fluid supplied from the third operating valve 44*c* is applied to the forward-travel pump pressure receiver 50*a* of the second travel pump 50R via the fifth travel fluid passage 42*e* and the third travel fluid passage 42*c*. The pilot pressure from the third operating valve 44*c* is applied to the rearward-travel pump pressure receiver 50*b* of the first travel pump 50L via the fifth travel fluid passage 42*e* and the second travel fluid passage 42*b*.

With this, the angle of the swash plates of the first travel pump 50L and the second travel pump 50R is changed, hydraulic fluid delivered by the first travel pump 50L flows through the circuit fluid passage 53*a* and is supplied through the second port 51*b* to the first travel motor 51L, and hydraulic fluid delivered by the second travel pump 50R flows through the circuit fluid passage 53*b* and is supplied through the third port 51*c* to the second travel motor 51R. Then, the output shaft 51Lj of the first travel motor 51L rotates in the reverse direction, the first traveling device 5 is driven to achieve rearward travel, the output shaft 51Rj of the second travel motor 51R rotates in the normal direction, the second traveling device 5 is driven to achieve forward travel, and the working machine 1 turns left.

When the travel operating lever 57*a* is pivoted in the rightward direction R, the fourth operating valve 44*d* is operated to allow pilot fluid to be supplied from the fourth operating valve 44*d* to the fifth travel fluid passage 42*e*. The pilot pressure of pilot fluid supplied from the fourth operating valve 44*d* is applied to the forward-travel pump pressure receiver 50*a* of the first travel pump 50L via the fifth travel fluid passage 42*e* and the first travel fluid passage 42*a*. The pilot pressure from the fourth operating valve 44*d* is applied to the rearward-travel pump pressure receiver 50*b* of the second travel pump 50R via the fifth travel fluid passage 42*e* and the fourth travel fluid passage 42*d*.

With this, the angle of the swash plates of the first travel pump 50L and the second travel pump 50R is changed, hydraulic fluid delivered by the first travel pump 50L flows through the circuit fluid passage 53*a* and is supplied through the first port 51*a* to the first travel motor 51L, and hydraulic fluid delivered by the second travel pump 50R flows through the circuit fluid passage 53*b* and is supplied through the fourth port 51*d* to the second travel motor 51R. Then, the output shaft 51Lj of the first travel motor 51L rotates in the normal direction, the first traveling device 5 is driven to achieve forward travel, the output shaft 51Rj of the second travel motor 51R rotates in the reverse direction, the second traveling device 5 is driven to achieve rearward travel, and the working machine 1 turns right.

When the travel operating lever 57*a* is pivoted diagonally, the difference between the pilot pressures applied to the forward-travel pump pressure receivers 50*a* and the rearward-travel pump pressure receivers 50*b* determines the directions and speeds of rotation of the output shafts 51Lj, 51Rj of the first travel motor 51L and the second travel motor 51R, and the working machine 1 turns right or left while traveling forward or rearward.

Specifically, when the travel operating lever 57*a* is pivoted diagonally leftward and forward, the working machine 1 turns left while traveling forward at a speed corresponding to the operation amount of the travel operating lever 57*a*. When the travel operating lever 57*a* is pivoted diagonally rightward and forward, the working machine 1 turns right while traveling forward at a speed corresponding to the operation amount of the travel operating lever 57*a*. When the travel operating lever 57*a* is pivoted diagonally leftward and rearward, the working machine 1 turns left while traveling rearward at a speed corresponding to the operation amount of the travel operating lever 57*a*. When the travel operating lever 57*a* is pivoted diagonally rightward and rearward, the working machine 1 turns right while traveling rearward at a speed corresponding to the operation amount of the travel operating lever 57*a*.

The working machine 1 includes speed-change switching valves 58L and 58R, a speed-change solenoid valve 59, and a speed-change switch 75. The speed-change switching valves 58L and 58R are two-position switching valves. The speed-change switching valve 58L is connected to the swash plate cylinder 52L by a fluid passage, and the speed-change switching valve 58R is connected to the swash plate cylinder 52R by a fluid passage. The speed-change switching valves 58L and 58R are connected to the speed-change solenoid valve 59 via a fluid passage 41. The speed-change solenoid valve 59 is a two-position solenoid switching valve including two positions and a solenoid to be energized in response to a control signal inputted thereto to switch between the positions. The speed-change solenoid valve 59 is connected to the fluid discharge passage 40, and switches the positions of the switching valves 58L and 58R. The speed-change switch 75 is an operating switch to be operated by the driver to input an instruction to switch the speed stage of the rotation speed of the output shafts 51Lj and 51Rj of the travel motor 51 to a first speed stage (low speed stage) or a second speed stage (high speed) higher than the first speed stage.

Upon receipt of an instruction to switch the speed stage to the first speed stage from the speed-change switch 75, the controller 20 inputs a control signal into the speed-change solenoid valve 59 to switch the speed-change solenoid valve 59 to the first position to block pilot fluid. With this, the pilot fluid from the fluid discharge passage 40 does not act on the pressure receivers of the speed-change switching valves 58L and 58R via the speed-change solenoid valve 59, the speed-change switching valves 58L and 58R are in the first position to block hydraulic fluid, and hydraulic fluid is not supplied from the speed-change switching valves 58L and 58R to the swash plate cylinders 52L and 52R. Thus, the swash plate cylinders 52L and 52R are caused to retract by the elastic force of a spring, and the rotation speed of the output shafts 51Lj and 51Rj of the travel motors 51 is switched to the first speed stage.

Upon receipt of an instruction to switch the speed stage to the second speed stage from the speed-change switch 75, the controller 20 inputs a control signal into the speed-change solenoid valve 59 to switch the speed-change solenoid valve 59 to the second position to allow pilot fluid to pass therethrough. With this, pilot fluid from the fluid discharge passage 40 acts on the pressure receivers of the speed-change switching valves 58L and 58R via the speed-change solenoid valve 59, the speed-change switching valves 58L and 58R switch to the second position to allow hydraulic fluid to pass therethrough, and hydraulic fluid is supplied from the speed-change switching valves 58L and 58R to the swash plate cylinders 52L and 52R. Thus, the swash plate cylinders 52L and 52R are caused to extend by the hydraulic pressure, and the rotation speed of the output shafts 51Lj and 51Rj of the travel motors 51 is switched to the second speed stage.

Regardless of whether the speed-change switch 75 is operated or not, the controller 20 may switch the positions of the speed-change solenoid valve 59 to automatically change the second speed stage to the first speed stage (automatic speed reduction) or automatically change the first speed stage to the second speed stage speed (automatic speed increase). In the case where work is performed using a specific attachment 11, the controller 20 switches the speed stage to the first speed stage to perform a low-speed mode (creep mode) in which the travel speed of the working machine 1 is kept at a low speed.

Figure 3:
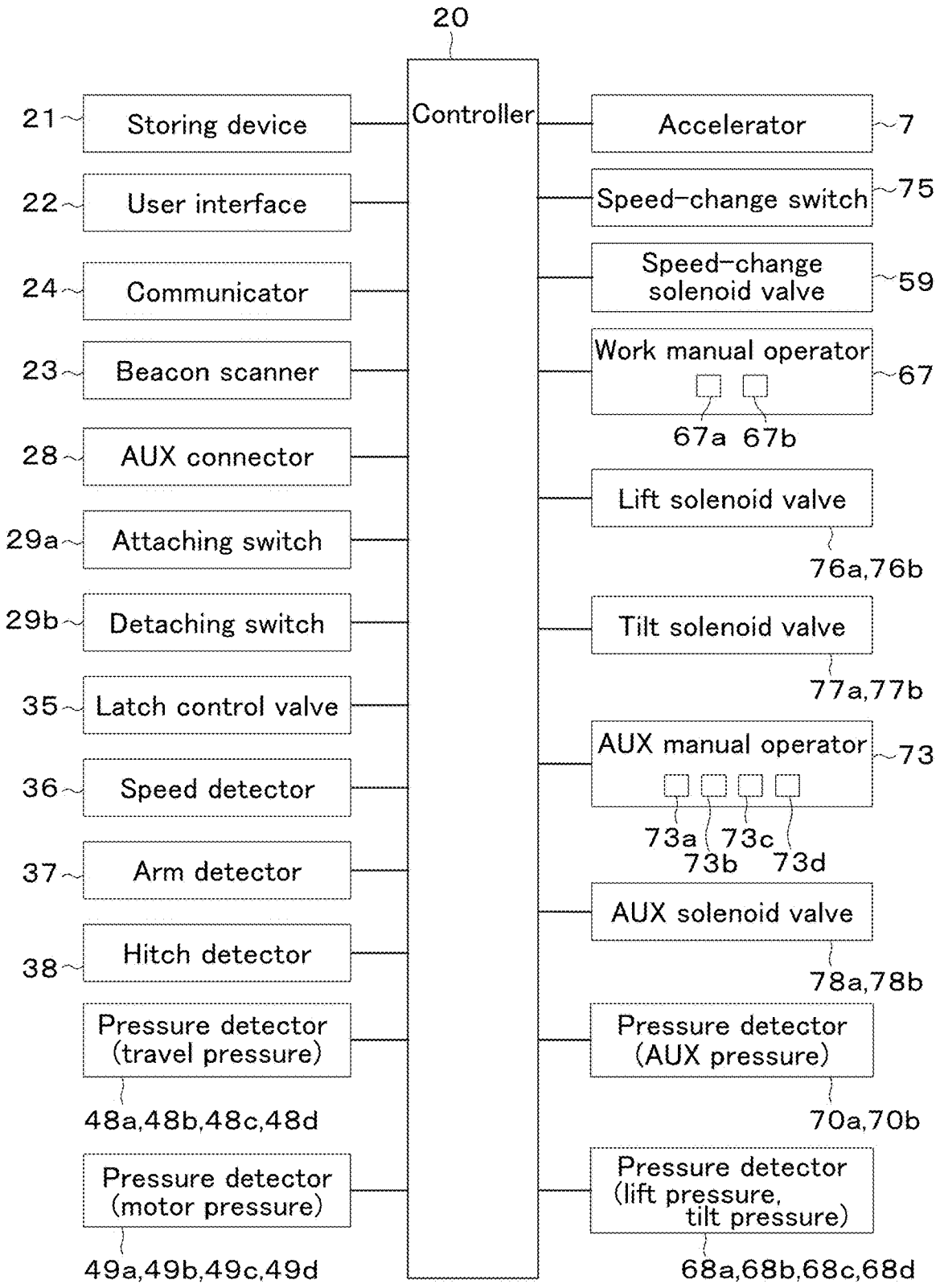
FIG. 3 is a block diagram showing an example of an electrical configuration of a working machine.

FIG. 3 is a block diagram showing an electrical configuration of the working machine 1. The working machine 1 includes elements shown in FIG. 3. The controller 20 includes a processing circuit including one or more processors. The working machine 1 includes the controller 20 which is configured or programmed to perform various controls relating to the working machine 1. The controller 20 is connected to the other elements shown in FIG. 3 in a communicable manner via in-vehicle network(s) such as CAN, ISOBUS, LIN and/or FlexRay.

The controller 20 includes at least one of one or more internal memories, analog circuits, digital circuits, and the like. The analog circuits and the digital circuits include one or more processors. The processor(s) included in the controller 20 include, for example, a central processing unit (CPU), a graphics processing unit (GPU), a digital signal processor (DSP), a field programmable gate array (FPGA), an application specific integrated circuit (ASIC) and/or the like.

The internal memory (memories) of the controller 20 is/are each a volatile or nonvolatile memory which stores software program(s) to be executed by one or more processors and various data. The controller 20 uses a predetermined storage area of the internal memory as a buffer to temporarily store information and data.

A storing device (memory and/or storage) 21 includes a nonvolatile memory and/or the like. The storing device 21 also stores software program(s) to be executed by one or more processors of the controller 20 and various data. The storing device 21 also stores control data corresponding to various attachments 11.

The one or more processors of the controller 20 read(s) software program(s) and control data from the internal memory and/or the storing device 21, and perform various processes based on the software program(s) and the control data. The one or more processors of the controller 20 may perform various processes based on a predetermined logic circuit.

Note that a plurality of physically separated processors of the controller 20 may operate together to perform various processes, and the configuration of the controller 20 is not limited to the above described configuration. In such a case, the plurality of processors are respectively provided in one or more computers which are physically separated from the working machine 1, and are connected in a communicable manner via a network such as a in-vehicle network, LAN, WAN, and/or the Internet.

The following configuration may be used: the above described software program(s) is/are stored in a storage medium (nonvolatile memory such as HDD, SSD, CD-ROM, DVD-ROM) connected in a communicable manner with the controller 20 and/or in external device(s) such as a server and/or the like connected via the above described network(s), and is/are installed from such storage medium (media) and/or the external device(s) into the internal memory or the storing device 21.

A user interface 22 is, for example, a terminal device (computer) in the form of a touchscreen or a tablet including a display. The user interface 22 is provided in the vicinity of the seat 8 inside the cabin 3 (FIG. 14). The controller 20 causes the user interface 22 to output (display) various information relating to the working machine 1 stored in the internal memory and/or the storing device 21 to the driver or the like (or to other user(s)).

The driver or the like of the working machine 1 inputs various information via the user interface 22. For example, information relating to the attachment 11 attached to the working device 4 can be inputted via the user interface 22. The controller 20 causes the internal memory and/or the storing device 21 to store the information inputted via the user interface 22. The user interface 22 functions as an input interface and an output interface. The user interface 22 may include input interface(s) such as at least one manual operator, e.g., a button, a switch, a dial, and/or a slider, and/or a microphone, and output device(s) such as a speaker.

A communicator 24 shown in FIG. 3 includes a communication circuit to wirelessly communicate with external device(s) such as a server, a terminal device and/or a portable device via the Internet, a wireless LAN and/or the like. The portable device is, for example, a smartphone or a tablet. The communicator 24 may include a receiver compliant with a satellite positioning system to receive radio waves from satellites. The communicator 24 also functions as an input interface and an output interface.

A beacon scanner 23 is a receiver to receive wireless signals compliant with a near field communication standard. Specifically, the beacon scanner 23 receives wireless signals (beacon signals) compliant with Bluetooth (registered trademark) Low Energy which is a near field communication standard. As shown in FIG. 14, the beacon scanner 23 is provided at a front portion of the machine body 2. In the case where a beacon transmitter 19 is provided on the attachment 11 attached to the hitch 16, the beacon scanner 23 receives wireless signals transmitted from the beacon transmitter 19. The beacon scanner 23 is an input interface.

In the case where the attachment 11 attached to the hitch 16 includes an electric circuit including a processor such as CPU, an electric harness connected to the electric circuit is connected to an AUX connector 28. The AUX connector 28 may communicate in a wired manner with the attachment 11, and functions as an input interface and an output interface.

An attaching switch 29*a*, a detaching switch 29*b*, an accelerator 7, the speed-change switch 75, the work manual operator 67, and an AUX manual operator 73 are provided in the vicinity of the seat 8 inside the cabin 3, and are operated by the driver of the working machine 1.

The attaching switch 29*a* is operated to attach the attachment 11 to the hitch 16. The detaching switch 29*b* is operated to allow the attachment 11 to be detached from the hitch 16. As another example, a single operating switch may be used as an attaching switch and a detaching switch.

Figure 4:
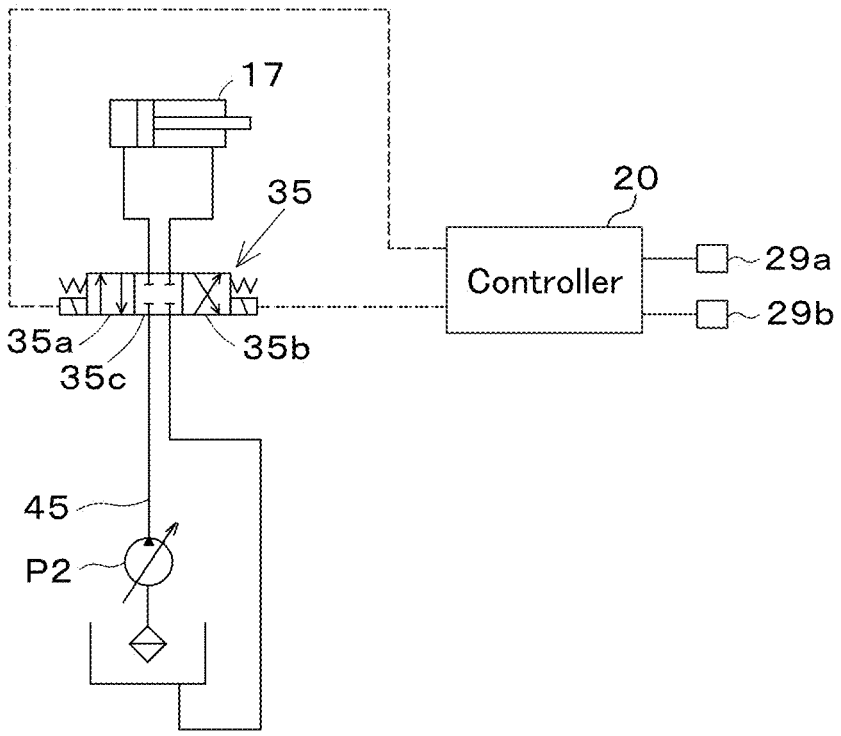
FIG. 4 illustrates an example of a hydraulic circuit to actuate a latch cylinder.

A latch control valve 35 is a three-position solenoid switching valve including three positions and a solenoid to be energized in response to a control signal inputted thereto to switch between the positions, and controls the latch cylinder 17. As shown in FIG. 4, the latch control valve 35 is connected to the latch cylinder 17 by fluid passages and is also connected to the main fluid passage 45. The latch control valve 35 is switchable between (i) a neutral position 35*c* to block hydraulic fluid from the fluid passage 45, (ii) a first position 35*a* to allow hydraulic fluid to be supplied to the cap-side chamber of the latch cylinder 17 to cause the latch cylinder 17 to extend, and (iii) a second position 35*b* to allow hydraulic fluid to be supplied to the rod-side chamber of the latch cylinder 17 to cause the latch cylinder 17 to retract.

For example, the driver of the working machine 1 operates the work manual operator 67 (FIG. 1) to lower the arms 10 and the hitch 16, and operates the travel manual operator 57 (FIG. 2) to cause the machine body 2 to travel forward very slowly, thus causing the front surface of the bracket 30 of the hitch 16 to contact the base plate 9 (FIG. 13) of the attachment 11 placed on the ground J. Then, when the driver operates the attaching switch 29*a*, the controller 20 inputs a control signal into the latch control valve 35 to switch the latch control valve 35 from the neutral position 35*c* to the first position 35*a*. With this, the latch cylinder 17 extends, the latching mechanisms 31 switch to the latching state, and the attachment 11 is attached (fixed) to the hitch 16.

The driver, while the working machine 1 is in the stopped state, operates the work manual operator 67 to lower the arms 10 and the hitch 16 to cause the attachment 11 attached to the hitch 16 to contact the ground. Then, when the driver operates the detaching switch 29*b*, the controller 20 inputs a control signal into the latch control valve 35 to switch the latch control valve 35 from the neutral position 35*c* to the second position 35*b*. With this, the latch cylinder 17 retracts, the latching mechanisms 31 switch to the unlatching state, and the attachment 11 is allowed to be detached from the hitch 16. In this state, when the driver operates the travel manual operator 57 to cause the machine body 2 to travel rearward, the attachment 11 is detached from the hitch 16.

A speed detector 36 shown in FIG. 3 detects the travel speed of the working machine 1 (machine body 2). Specifically, the speed detector 36 includes, for example, rotation speed sensor(s) to detect the rotation speed of the travel motors 51L and 51R (FIG. 2) and a calculator, and the calculator calculates the travel speed based on a detection signal from the rotation speed sensor(s). Note that the calculator may not be provided in the speed detector 36, and the controller 20 may calculate the travel speed based on the detection signal from the rotation speed sensor. The controller 20 calculates the travel distance by multiplying the travel speed of the machine body 2 by the travel time.

As another example, the travel manual operator 57 may include a sensor to detect the direction and angle of operation (pivoting) of the travel operating lever 57*a*, and the speed detector 36 or the controller 20 may calculate the travel speed based on a detection signal (electric signal) outputted from the sensor. More specifically, for example, the speed detector 36 or the controller 20 determines the direction and angle of operation of the travel operating lever 57*a* based on a detection signal from the sensor of the travel manual operator 57, calculates, as the operation amount of the travel operating lever 57*a*, the ratio of the angle of operation of the travel operating lever 57*a* to the maximum angle of pivoting of the travel operating lever 57*a*, and calculates the travel speed of the working machine 1 based on the operation amount.

Alternatively, the speed detector 36 or the controller 20 may calculate the position of the machine body 2 at regular intervals based on signals received by the receiver of the communicator 24 from satellites of a satellite positioning system, and calculate the travel speed of the working machine 1 based on time-series position data of the machine body 2. The configuration to detect the travel speed of the working machine 1 is not limited to the above, and a speed detector to detect the travel speed by some other known method may be used.

An arm detector 37 and a hitch detector 38 detect the position of the working device 4 that includes the position in the up-down direction, and may each include a sensor(s) such as an inertial measurement unit (IMU) and/or a potentiometer, for example. The arm detector 37 (first detector) detects the angle of rotation (swinging) of the arms 10 as the position (swinging position) of the arms 10 at least in the swinging direction. The arm detector 37, if including an inertial measurement unit, detects the three-dimensional position of the arms 10 and the inertial motion (position in three orthogonal axes, translational motion, and rotational motion) of the arms 10 to determine the acceleration and angular velocity of the arms 10. The controller 20, based on the detection results from the arm detector 37, determines the posture of the arms 10 that includes the position and orientation of the arms 10, the positions of the distal portion of the arms 10 and the hitch 16 in the up-down direction and in the front-rear direction, and the actuated position (the degree of extension/retraction) of the lift cylinders 14.

The hitch detector 38 (second detector) detects the tilt angle (angle of rotation (swinging)) of the hitch 16 as the position (swinging position) of the hitch 16 at least in the swinging direction. The hitch detector 38, if including an inertial measurement unit, detects the three-dimensional position of the hitch 16 and the inertial motion (position in three orthogonal axes, translational motion, and rotational motion) of the hitch 16 to determine the acceleration and angular velocity of the hitch 16. The controller 20, based on the detection results from the hitch detector 38, determines the posture of the hitch 16 that includes the position and orientation of the hitch 16, the position of the hitch 16 in the up-down direction and the position and orientation in the front-rear direction, and the actuated position (the degree of extension/retraction) of the tilt cylinders 15.

Furthermore, the controller 20 determines the behavior of the attachment 11 attached to the hitch 16, the position of the attachment 11 in the up-down direction, and the position and orientation of the attachment 11 in the front-rear direction based on the detection results(s) from the arm detector 37 and/or the hitch detector 38. Specifically, the controller 20 determines the direction of movement of a work surface 11*w* (FIG. 14) of the attachment 11 attached to the hitch 16 (any of four directions including up, down, forward, and rearward directions) and the position of the work surface 11*w* based at least on the detection result from the arm detector 37, and determines the orientation of the work surface 11*w* based on the detection result from the hitch detector 38. The work surface 11*w* is an imaginary surface defined at the contact portion of the attachment 11 that makes contact with the target object during work, and is a reference surface for the posture of the attachment 11.

As described above, the controller 20 determines the postures (position and orientation) of the arms 10 and the hitch 16 of the working device 4 and the posture of the attachment 11 attached to the working device 4 based on the detection results from the arm detector 37 and the hitch detector 38. Furthermore, the controller 20, based on the detection results from the arm detector 37 and the hitch detector 38, controls the working device 4 and actuates the working device 4 to change the posture of the attachment 11.

In addition to the foregoing pressure detectors 70*a* and 70*b*, the working machine 1 includes pressure detectors 48*a*,

48*b*, 48*c*, 48*d*, 49*a*, 49*b*, 49*c*, 49*d*, 68*a*, 68*b*, 68*c*, and 68*d* as elements to detect the pressure of hydraulic fluid or pilot fluid. Each of the pressure detectors 48*a* to 48*d*, 49*a* to 49*d* and 68*a* to 68*d* includes a pressure sensor.

The pressure detectors 48*a*, 48, 48*c*, and 48*d* are provided in the respective travel fluid passages 42*a*, 42*b*, 42*c*, and 42*d*, as illustrated in FIG. 2. The pressure detector 48*a* detects, as a first travel pressure, the pilot pressure of pilot fluid applied to the first travel fluid passage 42*a* and the forward-travel pump pressure receiver 50*a* of the first travel motor 51L. The pressure detector 48*b* detects, as a second travel pressure, the pilot pressure of pilot fluid applied to the second travel fluid passage 42*b* and the rearward-travel pump pressure receiver 50*b* of the first travel motor 51L. The pressure detector 48*c* detects, as a third travel pressure, the pilot pressure of pilot fluid applied to the third travel fluid passage 42*c* and the forward-travel pump pressure receiver 50*a* of the second travel motor 51R. The pressure detector 48*d* detects, as a fourth travel pressure, the pilot pressure of pilot fluid applied to the fourth travel fluid passage 42*d* and the rearward-travel pump pressure receiver 50*b* of the second travel motor 51R.

The controller 20 may determine the operation direction and operation amount of the travel operating lever 57*a* and also determine whether or not the travel manual operator 57 is operated to cause the machine body 2 to travel straight or whether or not the travel manual operator 57 is operated to cause the machine body 2 to turn, based on the first to fourth travel pressures detected by the pressure detectors 48*a* to 48*d*. The controller 20 may determine the travel direction, travel speed, whether straight travel is performed, whether turn is performed, the direction of turn, and the type of turn regarding the machine body 2 (working machine 1) based on the first to fourth travel pressures.

The pressure detectors 49*a*, 49*b*, 49*c* and 49*d* are provided in the circuit fluid passages 53*a* and 53*b*. The pressure detector 49*a* detects the pressure of hydraulic fluid acting on a first port 51*a* of the first travel motor 51L as a first motor pressure. The pressure detector 49*b* detects the pressure of hydraulic fluid acting on a second port 51*b* of the first travel motor 51L as a second motor pressure. The pressure detector 49*c* detects the pressure of hydraulic fluid acting on a third port 51*c* of the second travel motor 51R as a third motor pressure. The pressure detector 49*d* detects the pressure of hydraulic fluid acting on a fourth port 51*d* of the second travel motor 51R as a fourth motor pressure.

The controller 20 may determine the travel direction, the travel speed, whether straight travel is being performed, whether turning is being performed, the turn direction, and the type of turn relating to the working machine 1 based on the first to fourth motor pressures detected by the pressure detectors 49*a* to 49*d*. The controller 20 may determine the operation direction and operation amount of the travel operating lever 57*a* and also determine whether or not the travel manual operator 57 is operated to cause the machine body 2 to travel straight or whether or not the travel manual operator 57 is operated to cause the machine body 2 to turn, based on the first to fourth motor pressures.

As shown in FIG. 1, the pressure detectors 68*a*, 68*b*, 68*c* and 68*d* are respectively provided in the fluid passages 64*a*, 64*b*, 65*a* and 65*b*. The pressure detectors 68*a* and 68*b* detect the pressure of hydraulic fluid acting from the lift control valve 60A to the lift cylinders 14 as a lift pressure. The controller 20 refers to the lift pressure and, for example, adjusts the opening of the solenoid valves 76*a* and 76*b*. The pressure detectors 68*c* and 68*d* detect the pressure of hydraulic fluid acting from the tilt control valve 60B to the tilt cylinders 15 as a tilt pressure. The controller 20 refers to the tilt pressure and, for example, adjusts the opening of the tilt solenoid valves 77*a* and 77*b*. The controller 20 may determine whether or not the work manual operator 67 is operated to swing the arms 10 and the hitch 16 of the working device 4 and whether or not the work manual operator 67 is operated to change the posture of the attachment 11 based on the lift pressure and the tilt pressure.

The accelerator 7 is operable to define and change the rotation speed of the prime mover 6, and includes an acceleration operator and an acceleration sensor. The acceleration operator is, for example, an operation structure (manual operator) such as a lever, a pedal, a dial, or a slider. The acceleration sensor outputs a signal corresponding to the operation position of the acceleration operator. The controller 20 controls the driving of the prime mover 6 and defines and changes the rotation speed of the prime mover 6 based on an acceleration signal outputted from the acceleration sensor.

The configurations of the speed-change switch 75, the speed-change solenoid valve 59, the lift solenoid valves 76*a* and 76*b*, the tilt solenoid valves 77*a* and 77*b*, and the AUX solenoid valves 76*a* and 76*b* have been described already. The AUX manual operator 73 is operable to control the supply of hydraulic fluid to the auxiliary actuator 27 of the attachment 11. The AUX manual operator 73 includes, in addition to the foregoing AUX output switch 73*b*, an AUX mode switch 73*a*, an AUX steady switch 73*c*, and an AUX volume switch 73*d*.

The AUX mode switch 73*a* is turned ON to start an AUX mode in which an attachment 11 including an auxiliary actuator 27 is allowed to be used with the working machine 1, and is turned OFF to end the AUX mode. When the AUX mode switch 73*a* is turned ON to start the AUX mode and then the AUX output switch 73*b* is turned ON, the controller 20 opens one of the AUX solenoid valves 77*a* and 77*b* to allow hydraulic fluid to be supplied from the AUX control valve 60C to the corresponding AUX port 25.

In so doing, if the first AUX port 25*a* and the first hydraulic port of the attachment 11 are connected by the external fluid passage 26*a* and the second hydraulic port of the attachment 11 and the second AUX port 25*b* are connected by the external fluid passage 26*b*, (i) hydraulic fluid from the AUX control valve 60C flows through the first AUX port 25*a*, the external fluid passage 26*a*, and the first hydraulic port of the attachment 11 and is supplied to the auxiliary actuator 27 of the attachment 11, and (ii) hydraulic fluid discharged from the auxiliary actuator 27 flows through the second hydraulic port of the attachment 11, the external fluid passage 26*b*, and the second AUX port 25*b* and returns to the AUX control valve 60C. In some cases, hydraulic fluid from the AUX control valve 60C flows through the second AUX port 25*b*, the external fluid passage 26*b*, and the second hydraulic port of the attachment 11 and is supplied to the auxiliary actuator 27, whereas hydraulic fluid from the auxiliary actuator 27 flows through the first hydraulic port of the attachment 11, the external fluid passage 26*a*, and the first AUX port 25*a* and returns to the AUX control valve 60C.

The controller 20 ends the AUX mode when the AUX mode switch 73*a* is turned OFF after the AUX output switch 73*b* is turned OFF, the AUX solenoid valves 77*a* and 77*b* are closed, and the supply of hydraulic fluid from the AUX control valve 60C to the corresponding AUX port 25 is stopped.

The AUX steady switch 73*c* is turned ON to start a steady output mode in which the current state of supply of hydraulic fluid to the auxiliary actuator 27 (fluid flow rate) is kept constant, and is turned OFF to stop the steady output mode. When the AUX steady switch 73*c* is turned ON while the AUX mode is being performed to supply hydraulic fluid to the auxiliary actuator 27, the controller 20 starts the steady output mode and to maintain the opening of the AUX control valve 60C to keep constant the fluid flow rate of hydraulic fluid supplied to the auxiliary actuator 27. After that, when the AUX steady switch 73*c* is turned OFF, the controller 20 ends the steady output mode, does not maintain the opening of the AUX control valve 60C anymore, and does not keep constant the fluid flow rate of hydraulic fluid supplied to the auxiliary actuator 27 anymore.

The AUX volume switch 73*d* is operated to change the supply amount of hydraulic fluid to the auxiliary actuator 27. The AUX volume switch 73*d* outputs an electric signal corresponding to the manual operation of a control knob such as a slider operating switch, a dial, or a push button. When the AUX volume switch 73*d* is operated and an electric signal corresponding to the operation is inputted into the controller 20 when the steady supply mode is not performed, the controller 20 detects the operation position of the AUX volume switch 73*d* based on the electric signal, and inputs a control signal with an electric current value corresponding to the operation position into the AUX solenoid valves 78*a* and 78*b*. With this, the openings of the AUX solenoid valves 78*a* and 78*b* are defined and/or changed, the pilot pressure acting on the AUX control valve 60C changes, the opening of the AUX control valve 60C is defined and/or changed, the supply amount of hydraulic fluid from the AUX control valve 60C to the auxiliary actuator 27 is defined and/or changed, and the AUX pressure is also defined and/or changed.

After the attachment 11 is attached to the hitch 16, the controller 20 identifies the attachment 11. For example, in the case where the attached attachment 11 includes a beacon transmitter 19, a wireless signal including information relating to the attachment 11 is transmitted at regular intervals from the beacon transmitter 19, and therefore the wireless signal is received by the beacon scanner 23. The controller 20 identifies the attached attachment 11 based on the information included in the wireless signal received by the beacon scanner 23. For example, the information transmitted by the beacon transmitter 19 includes identification information of the attachment 11 provided with the beacon transmitter 19. The storing device 21 stores pieces of attachment information indicating a plurality of attachments 11 attachable to the working device 4 and pieces of control information defined for the respective plurality of attachments 11, which are associated with each other.

FIG. 5 illustrates an example, in the form of a table, of pieces of attachment information of the plurality of attachments 11 attachable to the working device 4 and their corresponding pieces of control information. The pieces of information shown in FIG. 5 are stored in a predetermined storage area of the storing device 21.

The attachment information shown in FIG. 5 includes identification information (ID), name, icon data, model number, and specifications of a corresponding attachment 11. The specifications include information such as the size of the attachment 11, the position and orientation of the work surface 11*w* (FIG. 12) of the attachment 11 relative to the base plate 9 (FIG. 13), and whether the attachment 11 includes an auxiliary actuator 27. The specifications of the attachment information of the attachment 11 including an auxiliary actuator 27 may include specifications information such as the type and capacity of the auxiliary actuator 27.

The control information includes the default value of fluid flow rate, posture information, and/or the like. The fluid flow rate is the amount of hydraulic fluid supplied per unit time to the auxiliary actuator 27 of the corresponding attachment 11.

The posture information is information relating to the posture of the attachment 11. The posture information includes information relating to a work posture range and information relating to a travel posture range. The work posture range is the range of the posture of the attachment 11 for work. The travel posture range is the range of the posture which does not fall within the work posture range, and is the posture range of the attachment 11 for the machine body 2 (working machine 1) to travel stably.

Figure 6A:
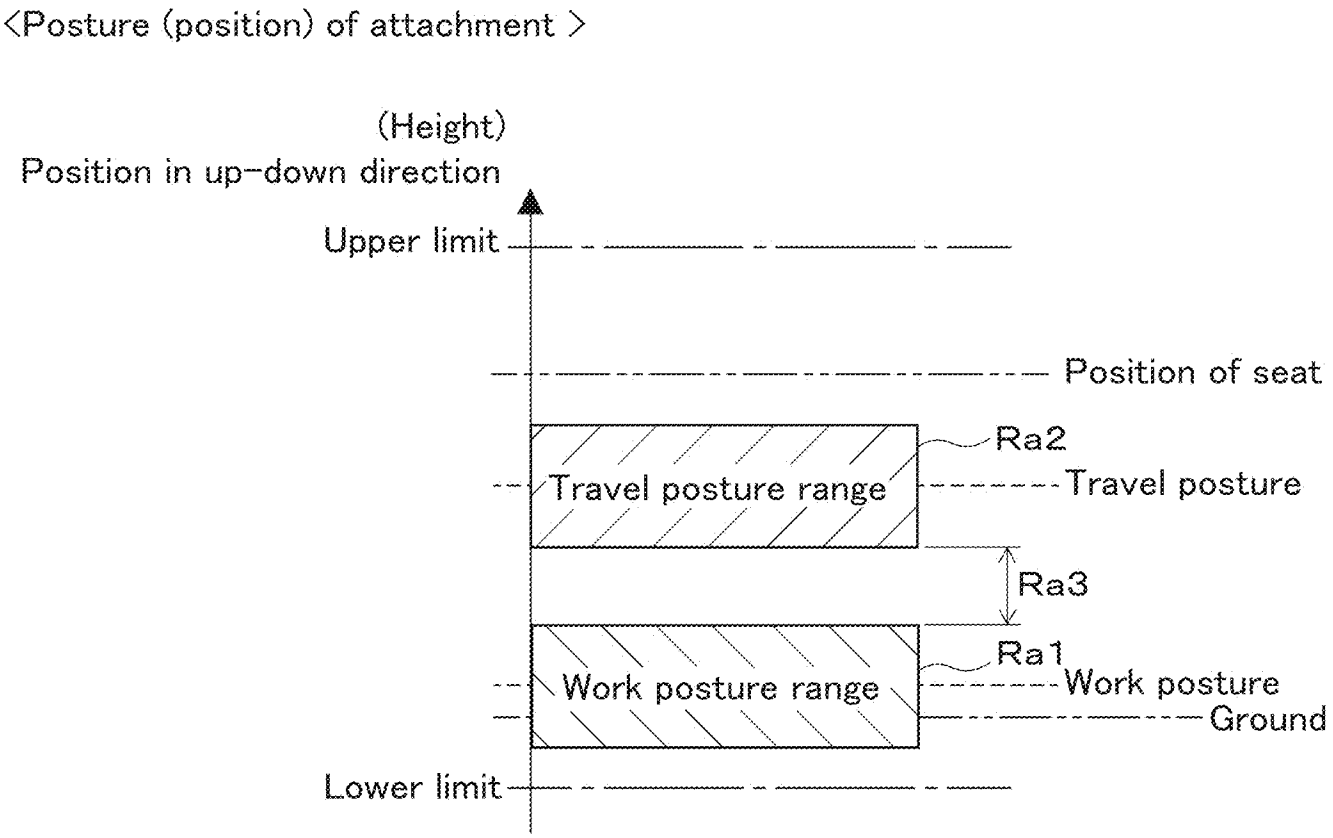
FIG. 6A is a conceptual view showing an example of ranges of the posture (position) of an attachment.
Figure 6B:
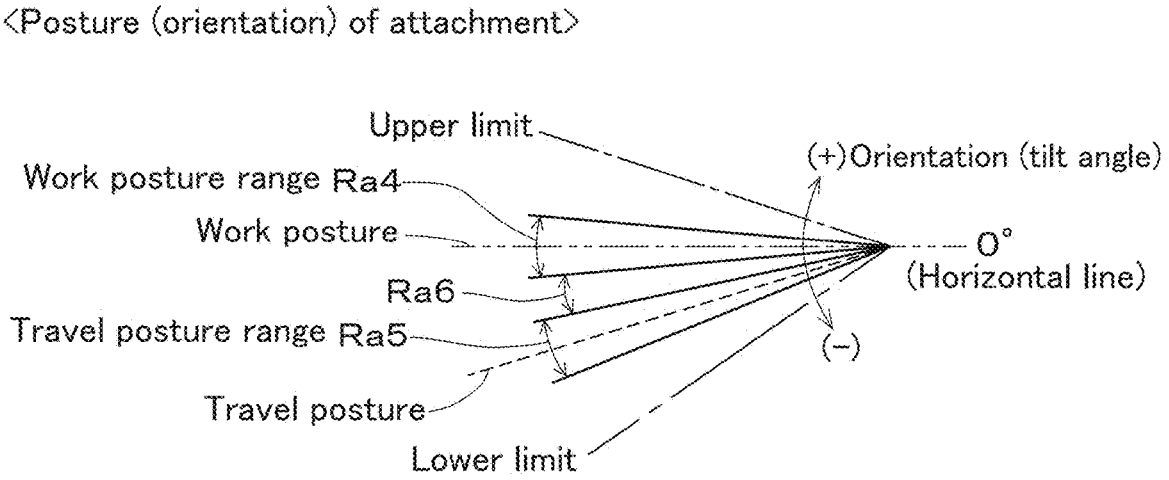
FIG. 6B is a conceptual view showing an example of ranges of the posture (orientation) of an attachment.

FIGS. 6A and 6B are each a conceptual view showing an example of posture ranges of the attachment 11. Specifically, FIG. 6A illustrates an example of the work posture range Ra1 and the travel posture range Ra2 which are position (height from the ground J) ranges in the up-down direction of the attachment 11. FIG. 6B illustrates an example of the work posture range Ra4 and the travel posture range Ra5 which are orientation (tilt angle relative to the horizontal plane) ranges of the attachment 11.

As illustrated in FIG. 6A, the work posture range (position range) Ra1 of the attachment 11 is defined above the lower limit of the range within which the position in the up-down direction of the attachment 11 can be changed. In the example in FIG. 6A, the lower limit of the work posture range Ra1 is defined below the ground J, and the upper limit of the work posture range Ra1 is defined above the ground J. Note that, depending on the type of attachment 11, the lower limit of the work posture range Ra1 may be defined at or above the ground J. The travel posture range Ra2 is defined above the work posture range Ra1 and below the upper limit of the range in which the position in the up-down direction of the attachment 11 can be changed.

As shown in FIG. 6B, the work posture range (orientation range) Ra4 of the attachment 11 is defined below the upper limit of the range in which the orientation of the attachment 11 can be changed. In the example in FIG. 6B, the lower limit of the work posture range Ra4 is set below 0 degrees which corresponds to the horizontal state (set to a negative value), and the upper limit of the work posture range Ra4 is set above 0 degrees (set to a positive value). The travel posture range (orientation range) Ra5 of the attachment 11 is defined below the work posture range Ra4 and below 0 degrees (negative values), and is defined above the lower limit of the range within which the orientation of the attachment 11 can be changed.

The travel posture ranges Ra2, Ra5 of the attachment 11 are each the range of posture in which the attachment 11 does not contact the ground. In the case where the attachment 11 is a contact/moved work attachment 11 to perform work by contacting a target object, the work posture ranges Ra1, Ra4 are each the range of posture in which the attachment 11 contacts the target object, and the travel posture ranges Ra2, Ra5 are each a posture range in which the attachment 11 does not contact the target object. In the example in FIGS. 6A and 6B, the work posture range Ra1, Ra4 and the travel posture range Ra2, Ra5 are not continuous. Postures (positions and orientations) of the attachment 11 included in an in-between range Ra3 between the work posture range Ra1, Ra4 and the travel posture range Ra2, Ra5 are neither the work posture nor the travel posture.

The posture information may include information indicating the range of the position in the up-down direction (vertical direction) of a work surface 11*w* of the attachment 11 (height of the work surface 11*w* from the bottom of the traveling devices 5 that makes contact with the ground) and information relating to the range of the orientation (tilt angle, or pitch angle relative to the front-rear direction) of the attachment 11, as information relating to the work posture range Ra1, Ra4 and information relating to the travel posture range Ra2, Ra5.

Additionally or alternatively, the posture information may include information relating to the posture of the working device 4 corresponding to the work posture range Ra1, Ra4 and the travel posture range Ra2, Ra5. Specifically, the posture information may include information indicating the ranges of actuated positions (actuation position) of the lift cylinders 14 and/or the tilt cylinders 15 corresponding to the work posture range Ra1, Ra4 and the travel posture range Ra2, Ra5.

Figure 6C:
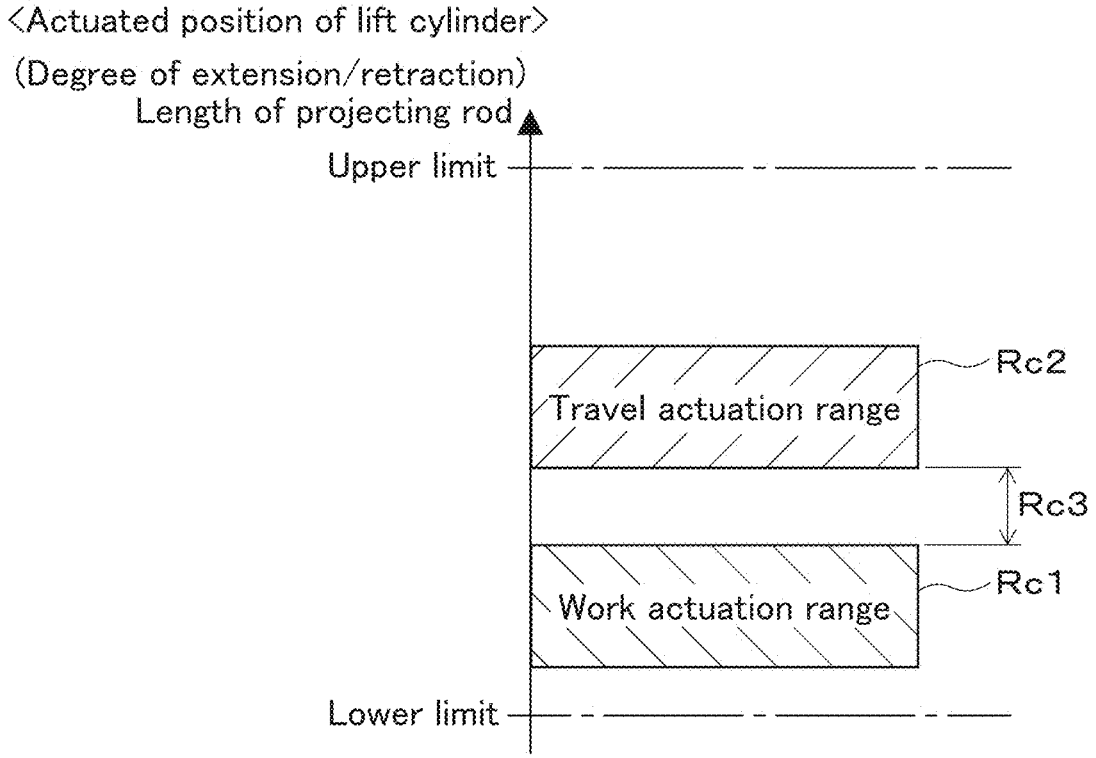
FIG. 6C is a conceptual view showing an example of ranges of actuated position of lift cylinders corresponding to the ranges of the posture of an attachment.

FIG. 6C is a conceptual view showing an example of actuation ranges of the lift cylinders 14 corresponding to the posture ranges of the attachment 11. The work actuation range (first range) Rc1 shown in FIG. 6C is the range of the actuated position (the length of the rod projecting from the case (degree of extension/retraction)) of the lift cylinders 14 that corresponds to the work posture range (work position range) Ra1 of the attachment 11 shown in FIG. 6A. The work actuation range Rc1 is defined above the lower limit of the range in which the actuated position of the lift cylinders 14 can be changed. The travel actuation range (second range) Rc2 is the range of the actuation position of the lift cylinders 14 that corresponds to the travel posture range (travel position range) Ra2 of the attachment 11 shown in FIG. 6A. The travel actuation range Rc2 is defined above the work actuation range Rc1 and below the upper limit of the range in which the actuation position of the lift cylinders 14 can be changed.

Figure 6D:
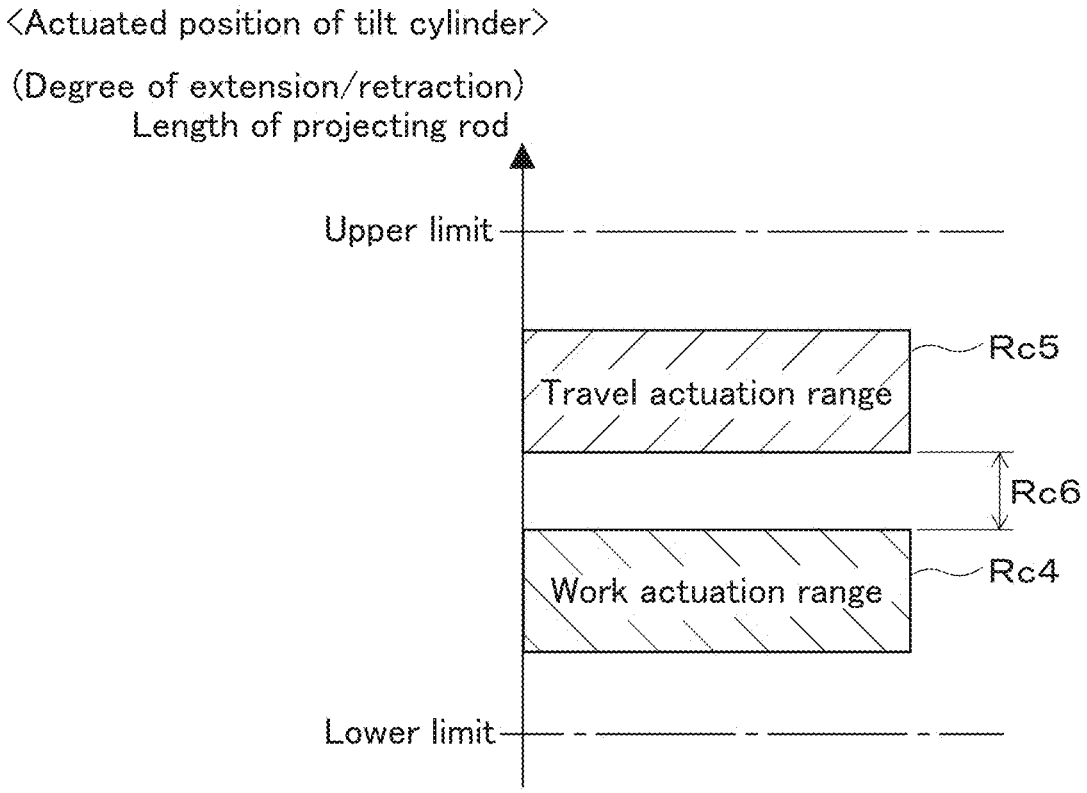
FIG. 6D is a conceptual view showing an example of ranges of actuated position of tilt cylinders corresponding to the ranges of the posture of an attachment.

FIG. 6D is a conceptual view showing an example of actuation ranges of the tilt cylinders 15 that correspond to the posture ranges of attachment 11. The work actuation range (fourth range) Rc4 shown in FIG. 6D is the range of the actuated position (the length of the rod projecting from the case (degree of extension/retraction)) of the tilt cylinders 15 that corresponds to the work posture range (work orientation range) Ra4 of the attachment 11 shown in FIG. 6B. The work actuation range Rc4 is defined above the lower limit of the range in which the actuated position of the tilt cylinders 15 can be changed. The travel actuation range (fifth range) Rc5 is the range of the actuation position of the tilt cylinders 15 that corresponds to the travel posture range (travel orientation range) Ra5 of the attachment 11 shown in FIG. 6B. The travel actuation range Rc5 is defined above the work actuation range Rc4 and below the upper limit of the range in which the actuation position of the tilt cylinders 15 can be changed.

The in-between range Rc3, Rc6 between the work actuation range Rc1, Rc4 and the travel actuation range Rc2, Rc5 in FIGS. 6C and 6D is the range of the actuation position of the lift cylinders 14 or the tilt cylinders 15 that corresponds to the in-between range Ra3, Ra6 shown in FIGS. 6A and 6B.

The posture information may include information indicating the ranges of the posture of the arms 10 and/or the hitch 16 (i.e., the posture of the working device 4) corresponding to the work posture range Ra1, Ra4 and the travel posture range Ra2, Ra5 of the attachment 11. In such a case, at least one of the swinging position (angle of rotation) of the arms 10 or the position in the up-down direction of the arms 10 detectable by the arm detector 37 may be defined as the posture of the arms 10. At least one of the swinging position (angle of rotation) of the hitch 16 or the position in the up-down direction of the hitch 16 detectable by the hitch detector 38 may be defined as the posture of the hitch 16.

Figure 6E:
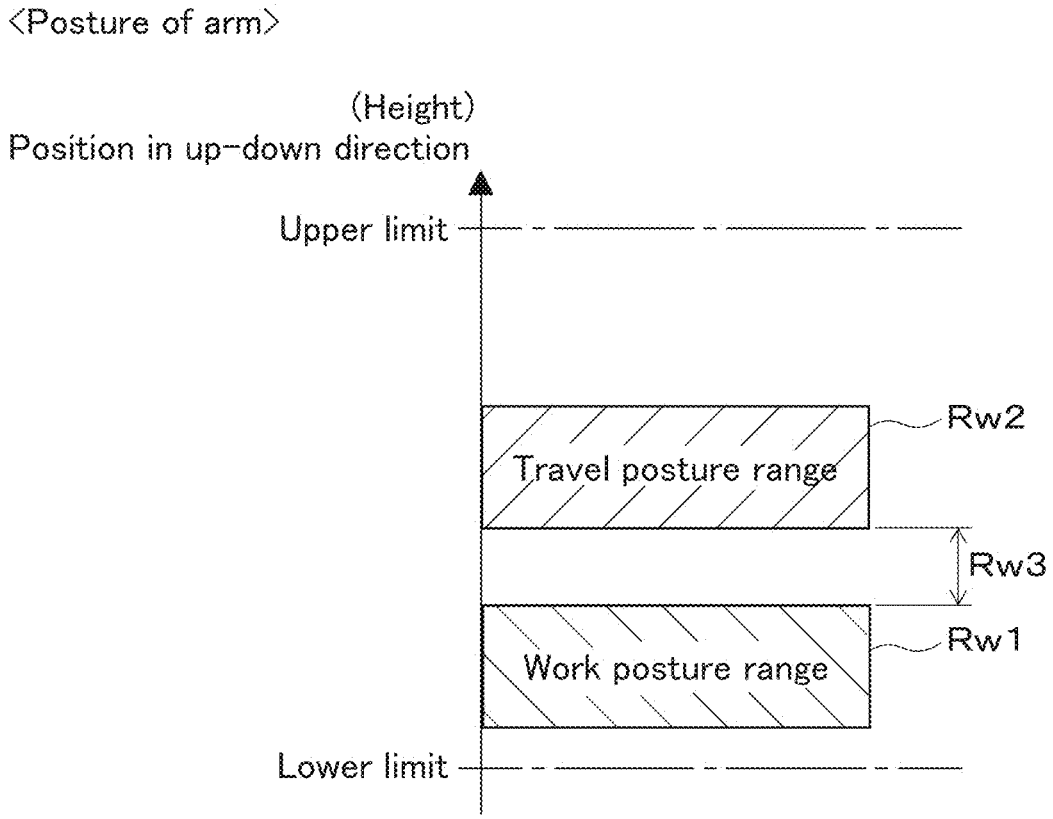
FIG. 6E is a conceptual view showing an example of ranges of the angle of rotation of arms corresponding to the ranges of the posture of an attachment.

FIG. 6E is a conceptual view showing an example of posture ranges of the arms 10 corresponding to the posture ranges of the attachment 11. The work posture range (first posture range) Rw1 shown in FIG. 6E is the range of the position in the up-down direction (height) of the distal portion of the arms 10 that corresponds to the work posture range (work position range) Ra1 of the attachment 11 shown in FIG. 6A. The work posture range Rw1 is defined above the lower limit of the range in which the position in the up-down direction of the distal portion of the arms 10 can be changed. The travel posture range (second posture range) Rw2 is the range of the position in the up-down direction of the distal portion of the arms 10 that corresponds to the travel posture range (travel position range) Ra2 of the attachment 11 shown in FIG. 6A. The travel posture range Rw2 is defined above the work posture range Rw1 and below the upper limit of the range in which the position in the up-down direction of the distal portion of the arms 10 can be changed.

Figure 6F:
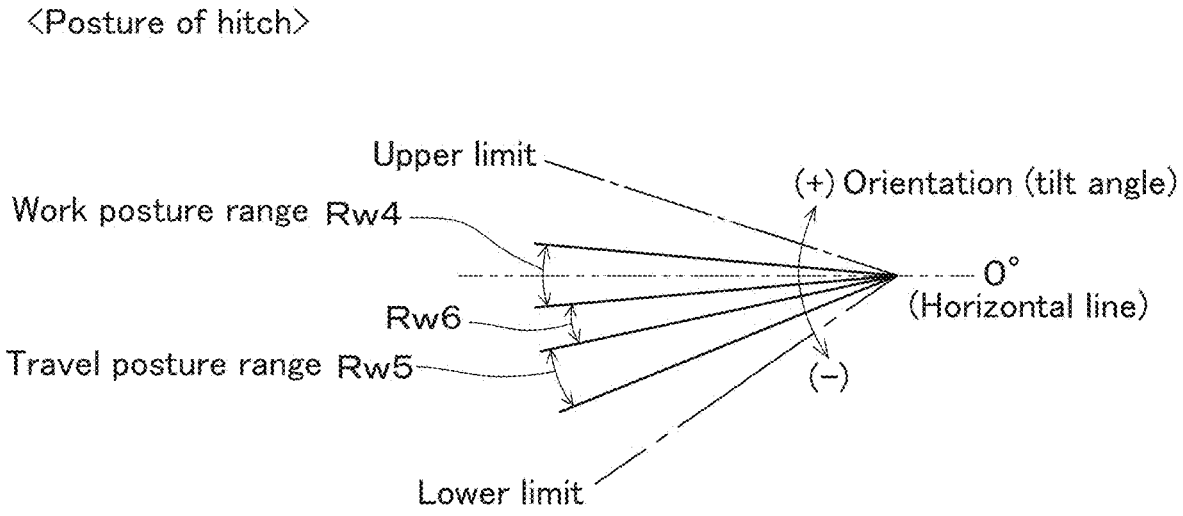
FIG. 6F is a conceptual view showing an example of ranges of the angle of rotation of a hitch corresponding to the ranges of the posture of an attachment.

FIG. 6F is a conceptual view showing an example of posture ranges of the hitch 16 corresponding to the posture ranges of the attachment 11. The work posture range (first posture range) Rw4 shown in FIG. 6F is the range of the angle of rotation of the hitch 16 that corresponds to the work posture range (work orientation range) Ra4 of the attachment 11 shown in FIG. 6B. The work posture range Rw4 is defined below the upper limit of the range in which the angle of rotation of the hitch 16 can be changed. The travel posture range (second posture range) Rw5 is the range of the angle of rotation of the hitch 16 that corresponds to the travel posture range (travel orientation range) Ra5 of the attachment 11 shown in FIG. 6B. The travel posture range Rw5 is defined below the work posture range Rw4 and above the lower limit of the range in which the angle of rotation of the hitch 16 can be changed.

The in-between range Rw3, Rw6 between the work posture range Rw1, Rw4 and the travel posture range Rw2, Rw5 in FIGS. 6E and 6F is the range of the angle of rotation of the arms 10 or the hitch 16 that corresponds to the in-between range Ra3, Ra6 shown in FIGS. 6A and 6B. Note that the ranges of the angle of rotation of the arms 10 may be defined as the posture ranges of the arms 10 that correspond to the posture ranges of the attachment 11.

For each of the plurality of attachments 11 attachable to the working device 4, related one or more of the default value of the fluid flow rate and the posture information are defined, and such defined information is included in the control information. In the example in FIG. 5, the control information for contacting/moved work attachments 11 such as a sweeper and a rake includes the default value of fluid flow rate and posture information. The control information for attachments 11 each including an auxiliary actuator 27 at least includes the default value of fluid flow rate, but the control information for attachments 11 including no auxiliary actuators 27 such as a bucket does not include the default value of fluid flow rate. The control information for attachments 11 other than the contacting/moved work attachments, such as a spreader and a grapple, does not include posture information.

As another example, the control information for attachments 11 other than contacting/moved work attachments 11 may also include posture information. The posture information may include information relating to the position of the attachment 11 but not include information relating to the orientation of the attachment 11. The attachment information may include at least one of the identification information (ID), name, icon, or model number of the attachment 11, and/or other information such as a nickname and/or the serial number of the attachment 11.

The controller 20 reads attachment information and control information corresponding to the information (identification information) about the attachment 11 received from the beacon transmitter 19 from the storing device 21. The controller 20 identifies the type of the attachment 11 and determines whether the attachment 11 includes an auxiliary actuator 27 based on the read attachment information.

In the case where an electric circuit including a controller such as a CPU is provided in the attachment 11, the controller 20 may, after an electric harness connected to the electric circuit is connected to the AUX connector 28, receive information relating to the attachment 11 transmitted from the controller via the electric harness and the AUX connector 28. The controller 20 may then read control information corresponding to the attachment 11 indicated by the received information from the storing device 21.

The information transmitted from an electronic device in or on the attachment 11, such as the beacon transmitter 19 or the controller of the attachment 11, may include the information relating to the attachment 11 and the control information corresponding to the attachment 11. In such a case, the controller 20, upon receipt of the information transmitted from the electronic device of the attachment 11 via the beacon scanner 23 or the AUX connector 28, reads (acquires) the information relating to the attachment 11 and the control information from the received information.

The control information transmitted from the electronic device of the attachment 11 may include at least one of the default value of the fluid flow rate or the posture information. The control information from the electronic device of the attachment 11 may include posture information indicating at least one of the actuated positions and actuation ranges of the lift cylinders 14 and the tilt cylinders 15 or the postures and posture ranges of the arms 10, the hitch 16, and the attachment 11. In such a case, the controller 20 acquires the information transmitted from the electronic device of the attachment 11 via the beacon scanner 23 or the AUX connector 28, and determines (selects) posture information from the acquired information.

In addition to or instead of the beacon transmitter 19 and the beacon scanner 23, a transmitter such as a Radio Frequency Identification (RFID) tag may be provided in or on the attachment 11 and a receiver to receive wireless signals issued by the transmitter may be provided in or on the working machine 1.

Figure 7:
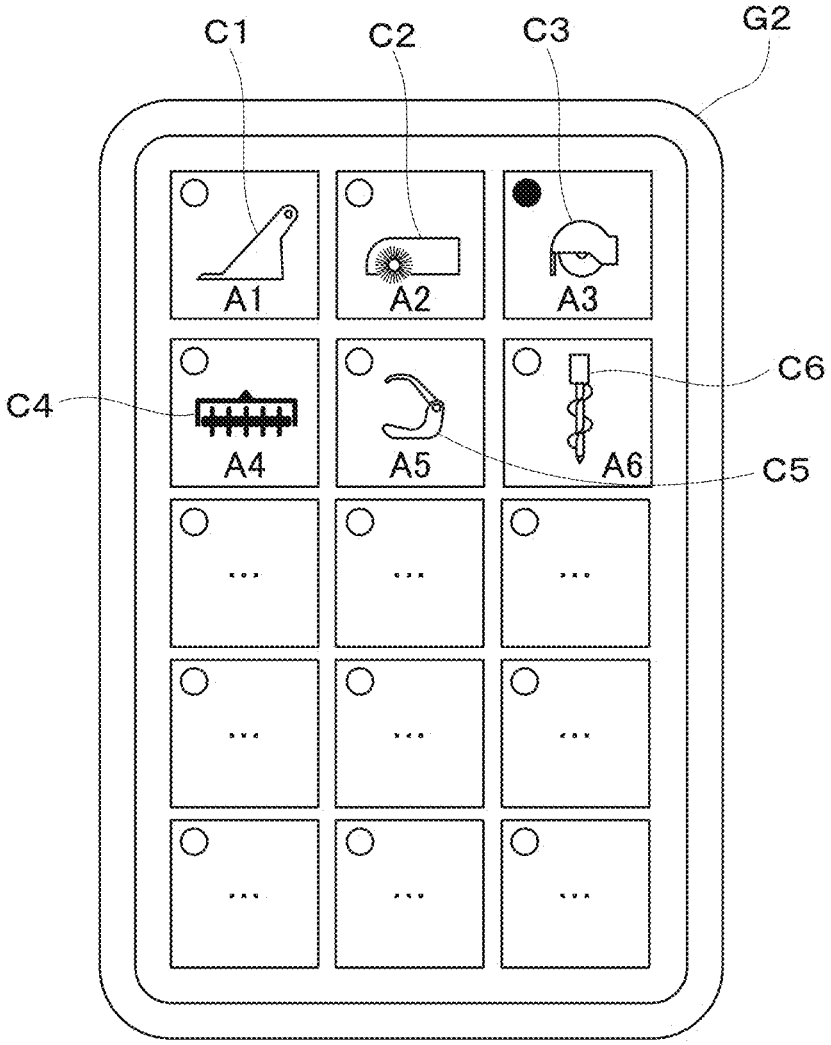
FIG. 7 illustrates an example of an input screen displaying icons of attachments.

Additionally or alternatively, the controller 20 may read from the storing device 21 the data of a plurality of icons C1, C2, C3, C4, C5, C6, and so on indicating respective attachments 11 attachable and detachable to and from the working device 4 and cause the user interface 22 to display the plurality of icons C1, C2, C3, C4, C5, C6, and so on, on a predetermined input screen G2 as illustrated in FIG. 7. In the example of FIG. 7, the controller 20 causes the plurality of icons C1, C2, C3, C4, C5, C6, and so on and the pieces of identification information A1, A2, A3, A4, A5, A6, and so on of the attachments 11 corresponding to the plurality of icons C1, C2, C3, C4, C5, C6, and so on to be displayed on the input screen G2.

The controller 20 may be configured or programmed to, when the driver or the like performs an operation on the user interface 22 to select an icon that represents the attachment 11 attached to the working device 4 from the plurality of icons C1, C2, C3, C4, C5, C6, and so on displayed on the input screen G2, accept the selected icon (icon C3 in FIG. 7) as information indicating the attachment 11 and read the control information for the attachment 11 corresponding to the selected icon from the storing device 21.

Additionally or alternatively, the following configuration may be used: the driver or the like manually inputs information such as the name of the attachment 11 attached to the working device 4 into the input screen displayed on the user interface 22. The controller 20 may then receive the manually inputted information from the user interface 22, and read the control information corresponding to the information from the storing device 21.

Additionally or alternatively, the following configuration may be used: an input screen as indicated in FIG. 7 or an input screen for manual input is displayed on a display of an external device such as a smartphone, and information relating to the attachment 11 corresponding to the icon selected by the user via the input screen or manually inputted information relating to the attachment 11 is transmitted from the external device and received by (inputted into) the communicator 24. The controller 20 may then read, from the storing device 21, the control information corresponding to the information relating to the attachment 11 received by the communicator 24.

The controller 20 is configured or programmed to, in the case where the control information acquired from the storing device 21 or the like (such as the beacon scanner 23 or the AUX connector 28) includes the default value of the fluid flow rate, control the AUX solenoid valves 78*a* and 78*b* and the AUX control valve 60C such that hydraulic fluid is supplied to the auxiliary actuator 27 at the default fluid flow rate when the AUX output switch 73*b* is operated, for example.

If the acquired control information includes posture information, the controller 20 determines information relating to the work posture range and the travel posture range based on the posture information. The controller 20 also, based on the detection result(s) from at least one of the arm detector 37 or the hitch detector 38, determines the current posture of at least one of the attachment 11 or the working device 4 (at least one of the position and orientation of the attachment 11, and actuated positions of the lift cylinders 14, the tilt cylinders 15, the arms 10 and the hitch 16).

The controller 20 then stops the working device 4 if, when the working device 4 is actuated by the operation of the work operating lever 67*a*, determining that the posture of the attachment 11 has changed to a posture falling within the work posture range or the travel posture range based on the information relating to the work posture range and the travel posture range and based on the current posture of at least one of the attachment 11 or the working device 4.

More specifically, when, in response to the operation of the work operating lever 67*a*, the controller 20 causes the lift solenoid valve 76*a*, 76*b*, the tilt solenoid valve 77*a*, 77*b*, the lift control valve 60A, and the tilt control valve 60B to actuate the lift cylinders 14 and/or the tilt cylinders 15 to change the posture of the working device 4 and the attachment 11 to bring the attachment 11 into a posture falling within the work posture range or the travel posture range, the controller 20 stops the working device 4 to set the posture of the attachment 11 at (position the attachment 11 in) a predetermined work posture in the work posture range or a specific travel posture in the travel posture range.

The controller 20 may define, as the predetermined work posture of the attachment 11, for example, the median of the work posture range of the attachment 11, and may define, as the predetermined travel posture, for example, the median of the travel posture range of the attachment 11. As another example, the controller 20 may define, as the predetermined work posture, a value within the work posture range of the attachment 11 other than the median, and may define, as the predetermined travel posture, a value within the travel posture range of the attachment 11 other than the median.

Figure 8A:
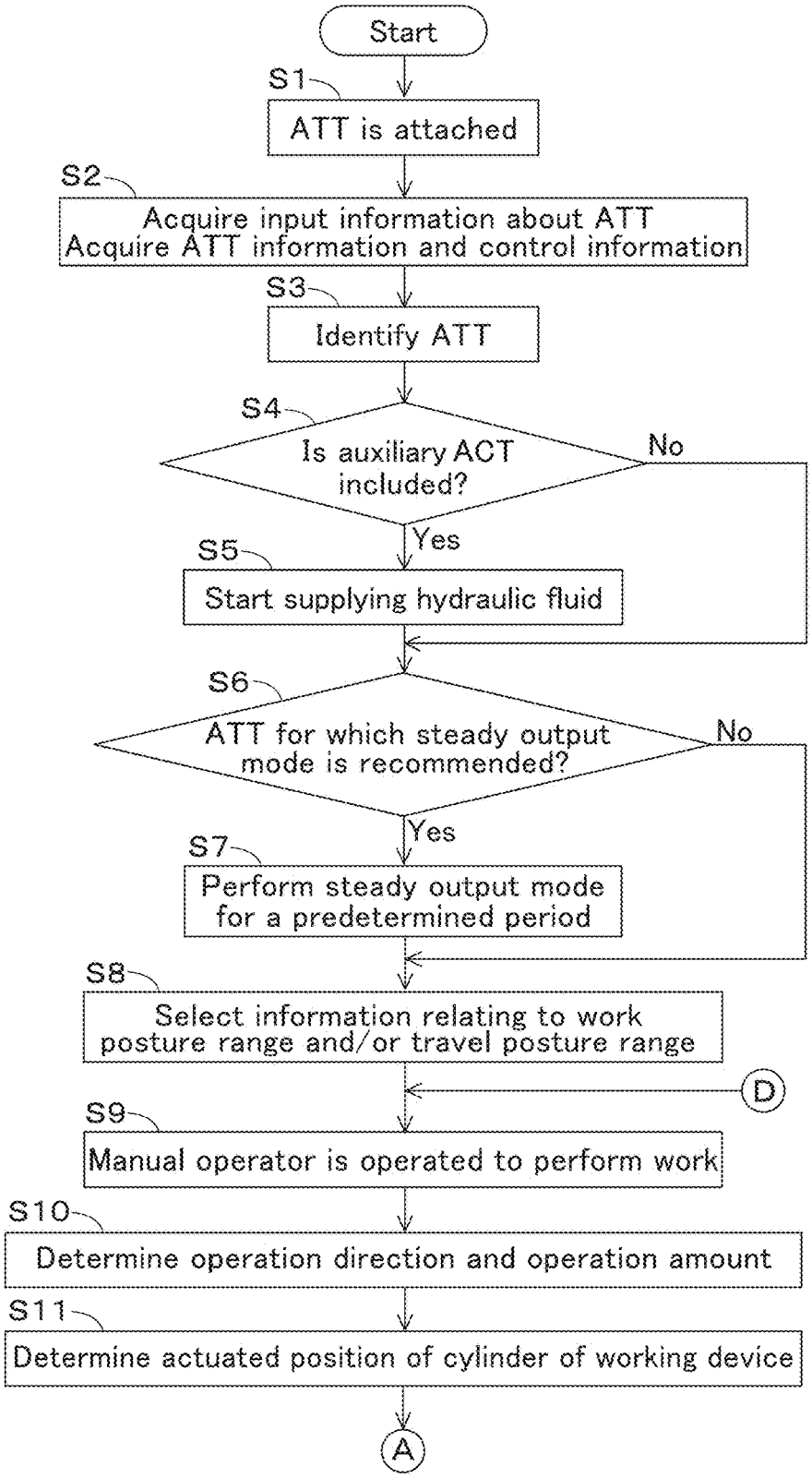
FIG. 8A is a flowchart showing an example of operation of a working machine.
Figure 8B:
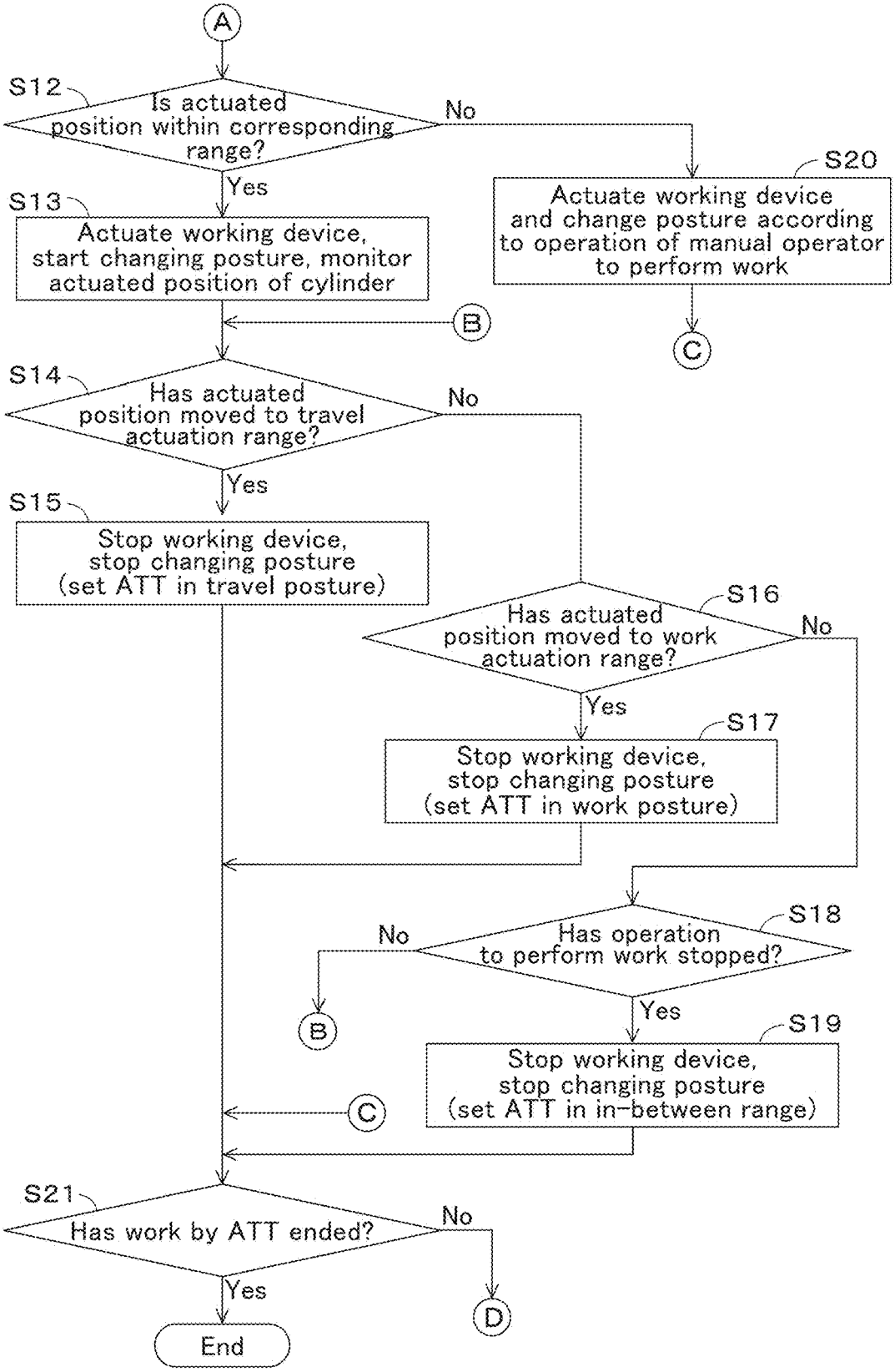
FIG. 8B is a flowchart continuing from FIG. 8A.

FIGS. 8A and 8B show a flowchart showing the operation of the working machine 1. The steps in FIGS. 8A and 8B are repeatedly performed by the controller 20 based on software program(s) stored in the internal memory and/or the storing device 21. For convenience, in FIGS. 8A and 8B, "attachment" is indicated as "ATT", and "actuator" is indicated as "ACT".

In response to the operation of the attaching switch 29*a*, the controller 20 actuates the latch cylinder 17 to attach the attachment 11 to the hitch 16 (S1 in FIG. 8A), then acquires input information relating to the attachment 11 inputted thereto from one of the input interfaces (second input interfaces) 23, 28, 22 and 24, and acquires (reads) attachment information and control information corresponding to the attachment 11 indicated by the input information from the storing device 21 (S2). The controller 20 then identifies the attachment 11 based on the acquired attachment information (S3). In so doing, the controller 20 identifies the type of the attachment 11, whether the attachment 11 includes an auxiliary actuator 27, and/or the like.

The controller 20, if determining that the attachment 11 includes an auxiliary actuator 27 (YES at S4), after starting the AUX mode in response to turning ON of the AUX mode switch 73*a*, starts supply of hydraulic fluid to the corresponding AUX port 25 from the AUX control valve 60C in response to turning ON of the AUX output switch 73*b* (S5). With this, hydraulic fluid is supplied from the AUX port 25 to the auxiliary actuator 27 of the attachment 11 via the corresponding external fluid passage 26 and the like to actuate the auxiliary actuator 27, so that the attachment 11 is driven. In so doing, the controller 20 actuates the AUX solenoid valves 78*a* and 78*b* to define the opening of the AUX control valve 60C such that the fluid flow rate of hydraulic fluid toward the AUX port 25 is the default value indicated by the control information.

If determining that the attachment 11 does not include auxiliary actuators 27 based on the attachment information (NO at S4), the controller 20 does not supply hydraulic fluid from the AUX control valve 60C to the corresponding AUX port 25.

After the answer is NO at step S4 or after step S5, the controller 20 determines whether or not the attachment 11 attached to the hitch 16 is a specific attachment 11 which includes an auxiliary actuator 27 and for which work in the steady output mode is recommended, based on the attachment information. The controller 20 refers to the result of identification at step S3, and, if the attached attachment 11 is not an attachment 11 for which the steady output mode is recommended (NO at S6), determines information relating to the work posture range and information relating to the travel posture range corresponding to the attachment 11 from the posture information included in the corresponding control information (S8).

If the attached attachment 11 is an attachment 11 for which the steady output mode is recommended (YES at S6), after the working machine 1 has been in the steady output mode for a predetermined period (S7), the controller 20 determines information relating to the work posture range and information relating to the travel posture range (S8). At step S8, the controller 20, for example, defines the work actuation range and the travel actuation range of the lift cylinders 14 and the tilt cylinders 15 corresponding to the work posture range and the travel posture range.

For example, in the case where the driver operates the work operating lever 67*a* forward or rearward in order to swing the arms 10 to raise or lower the attachment 11 attached to the working device 4, the controller 20 determines that the work operating lever 67*a* is operated to perform work based on the detection result from the sensor 67*b* of the work manual operator 67 (S9), and determines the operation direction and operation amount of the work operating lever 67*a* (S10). The controller 20 also determines the current actuated positions of the lift cylinders 14 and the tilt cylinders 15 corresponding to the current postures of the attachment 11 and the working device 4 based on the detection results from the arm detector 37 and the hitch detector 38 (S11).

If the current actuated position of the lift cylinders 14 and the current actuated position of the tilt cylinders 15 are both within the corresponding work actuation ranges, within the corresponding travel actuation ranges, or within the corresponding in-between ranges (YES at S12 in FIG. 8B), the controller 20 actuates the working device 4 based on the operation direction and operation amount of the work operating lever 67*a* to start changing the posture of the working device 4 and the attachment 11, and monitors the actuated positions of the lift cylinders 14 and the tilt cylinders 15 (S13).

That is, if the current posture of the attachment 11 is within the work posture range, within the travel posture range, or within the in-between range, actuates the lift solenoid valve 76*b*, the tilt solenoid valve 77*a*, the lift control valve 60A, and the tilt control valve 60B based on the operation direction and operation amount of the work operating lever 67*a* to cause the lift cylinders 14 and the tilt cylinders 15 to extend or retract to swing the arms 10 and the hitch 16, thus changing the position in the up-down direction and orientation of the working device 4 and the attachment 11. During the change, the controller 20 monitors the movement of the actuated positions of the lift cylinders 14 and the tilt cylinders 15.

When the current actuated positions of both the lift cylinders 14 and the tilt cylinders 15 have moved from the corresponding work actuation ranges or in-between ranges to the corresponding travel actuation ranges (YES at S14), the controller 20, even when the work operating lever 67*a* is being operated (i.e., even if the work operating lever 67*a* does not stop being operated), stops the actuation of the lift cylinders 14 and the tilt cylinders 15 to stop the swinging of the arms 10 and the hitch 16 to stop the actuation of the working device 4 to stop the change in posture of the working device 4 and the attachment 11 (S15). With this, the actuated positions of the lift cylinders 14 and the tilt cylinders 15 are each set at (the lift cylinders 14, the tilt cylinders 15 are positioned in) a specific position (e.g., median) of the corresponding travel actuation range, and the postures of the working device 4 (arms 10 and the hitch 16) and the attachment 11 are each set at a specific travel posture (e.g., median) of the travel posture range.

That is, the controller 20 is configured or programmed to, when the working device 4 is actuated by operation of the work operating lever 67*a* and the posture of the working device 4 and the attachment 11 changes to a posture within the travel posture range, stop actuating the working device 4, thus setting the posture of the working device 4 and the attachment 11 at a predetermined travel posture within the travel posture range.

The controller 20 is configured or programmed to, if the current actuated positions of both the lift cylinders 14 and the tilt cylinders 15 change from the corresponding travel actuation ranges or in-between ranges to the corresponding work actuation ranges (NO at S14, YES at S16), even when the work operating lever 67*a* is being operated, stop actuating the lift cylinders 14 and the tilt cylinders 15 to stop swinging the arms 10 and the hitch 16 to stop actuating the working device 4 to stop changing the posture of the working device 4 and the attachment 11 (S17). With this, the actuated positions of the lift cylinders 14 and the tilt cylinders 15 are set at predetermined positions (e.g., median) of the corresponding work actuation ranges (the lift cylinders 14 and the tilt cylinders 15 are positioned in predetermined positions), and the posture of the working device 4 (arms 10 and hitch 16) and the attachment 11 is set at a predetermined work posture (e.g., median) of the work posture range.

That is, the controller 20 is configured or programmed to, when the working device 4 is actuated by operation of the work operating lever 67*a* and the posture of the working device 4 and the attachment 11 changes to a posture within the work posture range, stop actuating the working device 4, thus setting the posture of the working device 4 and the attachment 11 at a predetermined work posture within the work posture range.

The controller 20 is configured or programmed to, if the work operating lever 67*a* stops being operated (working device is stopped) (YES at S18) before the current actuated positions of the lift cylinders 14 and/or the tilt cylinders 15 reach the corresponding travel actuation ranges or the corresponding work actuation ranges (NO at S14, NO at S16), stop actuating the lift cylinders 14 and the tilt cylinders 15 to stop actuating the working device 4 to stop changing the posture of the working device 4 and the attachment 11 (S19). With this, the actuated positions of the lift cylinders 14 and/or the tilt cylinders 15 are each set at a position falling within the in-between range between the work actuation range and the travel actuation range, and the posture of the working device 4 and the attachment 11 is set at a posture falling within the in-between range between the work posture range and the travel posture range.

In the above-described examples, the controller 20 is configured or programmed to, when causing the arms 10 to swing in response to operation of the work operating lever 67*a* to raise or lower the attachment 11, cause the hitch 16 to swing in response to the operation of the work operating lever 67*a* as the arms 10 swing so that the orientation of the attachment 11 relative to the target object or the like does not change. However, the controller 20 may be configured or programmed to, if a specific attachment 11 is attached to the working device 4, cause only the arms 10 to swing in response to operation of the work operating lever 67*a* to raise or lower the specific attachment 11 and allow the orientation of the attachment 11 relative to the target object or the like to change.

In such a case, the controller 20 may be configured or programmed to determine the current actuated position of the lift cylinders 14 based on the detection result from the arm detector 37 at step S11 in FIG. 8A and, if the current actuated position of the lift cylinders 14 is within the corresponding work actuation range, within the corresponding travel actuation range, or within the corresponding in-between range (YES at S12 in FIG. 8B), actuate the lift cylinders 14 according to the operation direction and operation amount of the work operating lever 67*a* at step S13 to swing the arms 10 to start changing the posture of the working device 4 and the attachment 11 and monitor only the actuated position of the lift cylinders 14.

The controller 20 may then, if the current actuated position of the lift cylinders 14 changes to the travel actuation range or the work actuation range (YES at S14 or YES at S16), or if the work operating lever 67*a* stops being operated (YES at S18) before the current actuated position of the lift cylinders 14 changes to the travel actuation range or the work actuation range (NO at S14, NO at S16), stop actuating the working device 4 (lift cylinders 14 and arms 10) to stop changing the posture of the working device 4 and the attachment 11 (S15, S17, or S19).

Also in the case where the driver operates the work operating lever 67*a* forward or rearward to swing the arms 10 to change the orientation of the attachment 11 attached to the working device 4, the controller 20 may determine (monitor) the current actuated position of the lift cylinders 14 without determining (monitoring) the actuated position of the tilt cylinders 15 at steps S11 and S13. The controller 20 may then determine whether the current actuated position of the lift cylinders 14 is within the work actuation range, within the travel actuation range, or within the in-between range, and determine whether the actuated position of the lift cylinders 14 has moved to the travel actuation range or the work actuation range.

In the case where the driver operates the work operating lever 67*a* leftward or rightward to swing the hitch 16 to change the orientation of the attachment 11 attached to the working device 4, the controller 20 may, after steps S9 and S10 in FIG. 8A, determine the current actuated position of the tilt cylinders 15 based on the detection result from the hitch detector 38 at step S11. The controller 20 may then, if the current actuated position of the tilt cylinders 15 is within the corresponding work actuation range, within the corresponding travel actuation range, or within the corresponding in-between range (YES at S12 in FIG. 8B), actuate the tilt cylinders 15 according to the operation direction and operation amount of the work operating lever 67*a* at step S13 to swing the hitch 16 to start changing the posture of the working device 4 and the attachment 11 and monitor only the actuated position of the tilt cylinders 15.

The controller 20 may then, if the current actuated position of the tilt cylinders 15 changes to the travel actuation range or the work actuation range (YES at S14 or YES at S16), or if the work operating lever 67*a* stops being operated (YES at S18) before the current actuated position of the tilt cylinders 15 changes to the travel actuation range or the work actuation range (NO at S14, NO at S16), stop actuating the working device 4 (tilt cylinders 15 and hitch 16) to stop changing the posture of the working device 4 and the attachment 11 (S15, S17, or S19).

After starting changing the posture of the working device 4 and the attachment 11 at step S14 as described above, the controller 20 may reduce the actuation speed of the lift cylinders 14 as the actuated position of the lift cylinders 14 approaches from the in-between range to the travel actuation range or to the work actuation range. The controller 20 may reduce the actuation speed of the tilt cylinders 15 as the actuated position of the tilt cylinders 15 approaches from the in-between range to the travel actuation range or to the work actuation range.

As described above, after the posture of the attachment 11 changed by the operation of the work operating lever 67*a* in a first direction is limited to travel postures falling within the travel posture range or work postures falling within the work posture range (S15, S17), for example, the driver moves the work operating lever 67*a* temporarily back to the neutral position and then operates the work operating lever 67*a* again in the same first direction. In such a case, the controller 20 allows the posture of the attachment 11 to be changed to a posture not falling within the travel posture range or the work posture range by the working device 4 actuated by thus operating the work operating lever 67*a* again.

That is, the controller 20, according to the operation direction and operation amount of the work operating lever 67*a* thus operated again, actuates the lift cylinders 14 and/or the tilt cylinders 15 to swing the arms 10 and/or the hitch 16 to change the posture of the working device 4 and the attachment 11. In so doing, as long as the work operating lever 67*a* is being thus operated again, even if the actuated position of the lift cylinders 14 and/or the tilt cylinders 15 changes to the corresponding travel actuation range or the corresponding work actuation range, the controller 20 does not stop actuating the lift cylinders 14 and/or the tilt cylinders 15, and, even if the posture of the attachment 11 changes to a posture falling within the travel posture range or the work posture range, the controller 20 does not stop actuating the working device 4. With this, the posture of the attachment 11 is allowed to be changed, by thus operating the work operating lever 67*a* again, to (i) a posture included in the in-between range and not included in the travel posture range or the work posture range or (ii) a posture not included in the travel posture range, the work posture range, or the in-between range.

If the current actuated position of the lift cylinders 14 and/or the tilt cylinders 15 determined at step S11 is not within the corresponding work actuation range, within the travel actuation range, or within the in-between range, the controller 20 determines that the current posture of the attachment 11 is not within the work posture range, within the travel posture range, or within the in-between range (NO at S12 in FIG. 8B). The controller 20 then actuates the working device 4 according to the operation direction and operation amount of the work operating lever 67*a* to change the posture of the working device 4 and the attachment 11 (S20). In such a case, as long as the work operating lever 67*a* is being operated, even if the actuated position of the lift cylinders 14 and/or the tilt cylinders 15 changes to the corresponding travel actuation range or the corresponding work actuation range, the controller 20 does not stop actuating the lift cylinders 14 and/or the tilt cylinders 15, and allows the posture of the working device 4 and the attachment 11 to be changed to a posture not falling within the travel posture range or the work posture range.

That is, the controller 20 is configured or programmed to, if the working device 4 is actuated by operation of the work operating lever 67*a* when the posture of the attachment 11 is not within the work posture range, within the travel posture range, or within the in-between range, as long as the work operating lever 67*a* is being operated, not stop actuating the working device 4 even if the posture of the attachment 11 changes to a posture falling within the travel posture range or the work posture range. This allows the posture of the attachment 11 to be changed to a desired posture by manual operation of the work operating lever 67*a*.

After step S15, S17, S19, or S20, if the work performed by the attachment 11 has not ended (NO at S21), the controller 20 performs step S9 in FIG. 8A and subsequent steps. When the work performed by the attachment 11 ends (YES at S21 in FIG. 8B), the controller 20 ends the series of operation in FIGS. 8A and 8B.

Note that the controller 20 determines that the work performed by the attachment 11 has ended (YES at S21) when, for example, the controller 20 stops supplying hydraulic fluid to the corresponding AUX port 25 (i.e., to the auxiliary actuator 27) in response to turning OFF of the AUX output switch 73*b*. The controller 20 determines that the work performed by the attachment 11 has ended (YES at S21) also when the prime mover 6 stops in response to turning OFF of the power switch on the working machine 1 and when the attachment 11 is allowed to be detached from the hitch 16 in response to turning ON of the detaching switch 29*b*. If such work end conditions are not satisfied, the controller 20 determines that the work performed by the attachment 11 has not ended (NO at S21).

As described earlier, if the attachment 11 attached to the working device 4 is an attachment 11 for which the steady output mode is to be performed (YES at S6 in FIG. 8A), the controller 20, after the working machine 1 has been in the steady output mode for a predetermined period of time (S7), limits the posture of the attachment 11 changed by operation of the work operating lever 67*a* to travel postures falling within the travel posture range or work postures falling within the work posture range (S15, S17 in FIG. 8B). However, if the attachment 11 attached to the working device 4 is an attachment 11 for which the steady output mode is to be performed (YES at S6 in FIG. 8A) and the work operating lever 67*a* is operated with the working machine 1 not in the steady output mode, the controller 20 allows the working device 4 to be actuated by operation of the work operating lever 67*a* to change the posture of the attachment 11 to a posture not falling within the travel posture range or the work posture range.

The controller 20 starts the steady output mode when the AUX steady switch 73*c* is turned ON. Note, however, that when the posture of the attachment 11 is not within the work posture range, within the travel posture range, or within the in-between range, the controller 20 may not start the steady output mode even if the AUX steady switch 73*c* is turned ON and prohibit or stop the steady output mode.

The controller 20 may be configured or programmed to, in addition to or instead of defining the work actuation range and the travel actuation range for the lift cylinders 14 and the tilt cylinders 15 at step S8 in FIG. 8A, define the work posture range and the travel posture range for the working device 4, determine the current posture of the working device 4 at steps S11 and S13, and perform determination at steps S12, S14, and S16 in FIG. 8B based on the current posture of the working device 4. The controller 20 may be configured or programmed to define the work posture range and the travel posture range of at least the arms 10 (of the arms 10 and the hitch 16) and determine the posture of at least the arms 10 (of the arms 10 and the hitch 16), as the work posture range, the travel posture range and the posture of the working device 4. The controller 20 may be configured or programmed to determine the position in the up-down direction of at least the distal portion of the arms 10 (or the position in the up-down direction of the hitch 16) as the posture of the arms 10 (or the hitch 16).

Alternatively, the controller 20 may be configured or programmed to define the work posture range and the travel posture range of the attachment 11 at step S8 in FIG. 8A, determine the current posture of the attachment 11 at step S11 in FIG. 8A and step S13 in FIG. 8B, and perform determination at steps S12, S14, and S16 in FIG. 8B based on the current posture of the attachment 11. The controller 20 may be configured or programmed to define the work posture range and the travel posture range corresponding to at least the position in the up-down direction of the attachment 11 (of the position in the up-down direction and the orientation of the attachment 11), and determine the position as the posture.

If the work operating lever 67*a* is being operated when step S15, S17 is performed, the working device 4 automatically stops being actuated and the working device 4 and the attachment 11 also automatically stop being changed in posture. The controller 20 may be configured or programmed to cause the user interface 22 to output (display) information indicating that the change in posture is stopped so that the driver of the working machine 1, etc., can know that the attachment 11 automatically stopped being changed in posture.

Figure 9A:
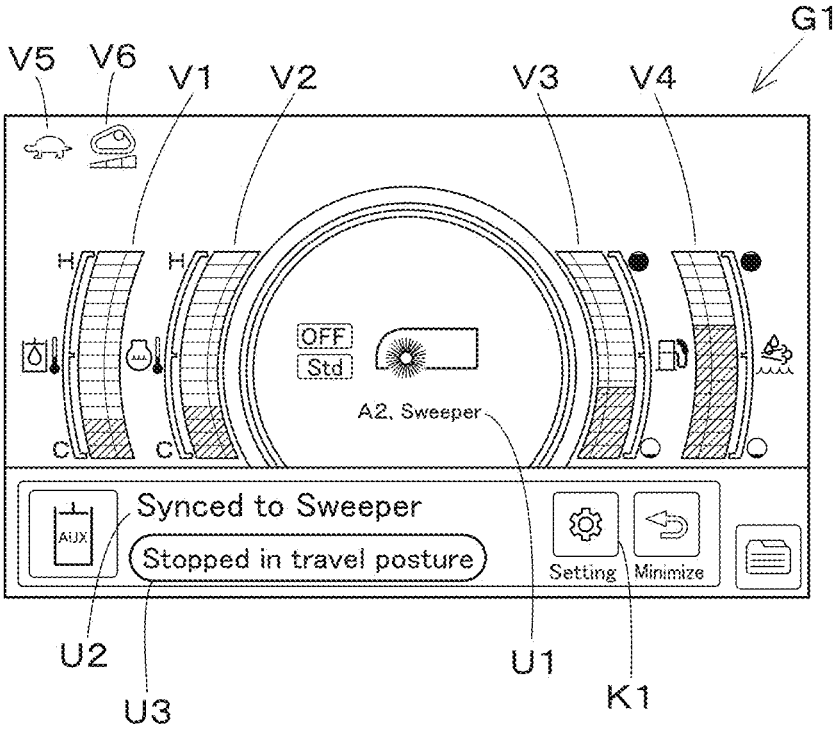
FIG. 9A illustrates an example of indications when an attachment is stopped in a travel posture.
Figure 9B:
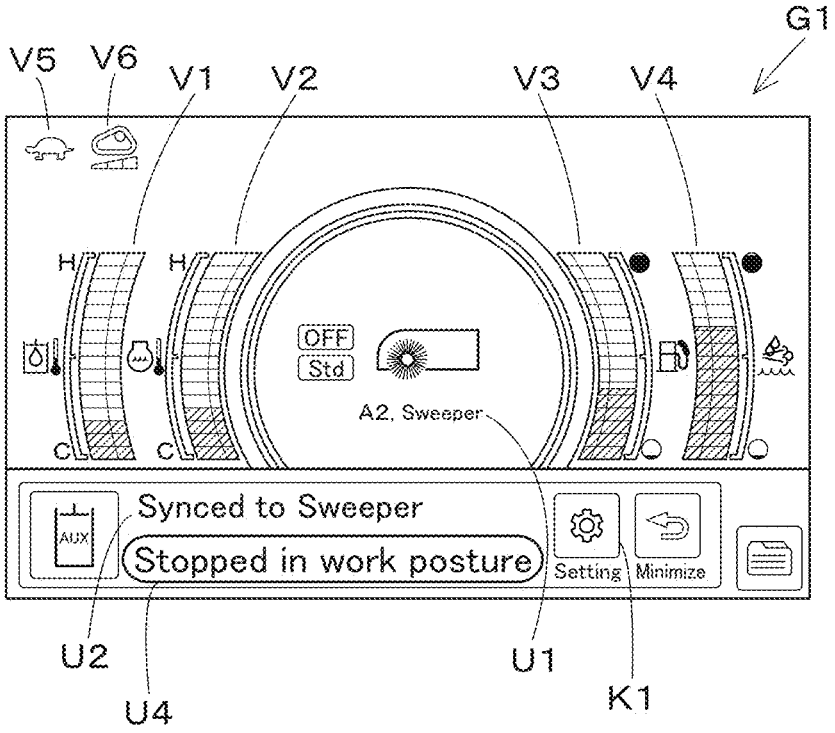
FIG. 9B illustrates an example of indications when an attachment is stopped in a work posture.

FIGS. 9A and 9B each illustrate an example of a monitor screen G1 displayed on the user interface 22. The controller 20 causes the user interface 22 to display the monitor screen G1 while the working machine 1 is in operation. The monitor screen G1 displays pieces of information V1 to V6 indicating the state of the working machine 1 detected by sensors in or on the working machine 1, the current date and time, and pieces of information U1 and U2 indicating the attachment 11 identified by the controller 20.

The controller 20, when performing step S15 in FIG. 8B, causes the monitor screen G1 to display information U3 indicating that the attachment 11 was stopped in a travel posture as shown in FIG. 9A. The controller 20, when performing step S17, causes the monitor screen G1 to display information U4 indicating that the attachment 11 was stopped in a work posture as shown in FIG. 9B.

The controller 20 may cause the display of an external device such as a smartphone, instead of the user interface 22, to display (output) the monitor screen G1. In such a case, the controller 20 need only transmit display data of the monitor screen G1 and information to be displayed on the monitor screen G1 to the external device via the communicator 24, and cause the display of the external device to display the monitor screen G1 including the pieces of information U3, U4.

Figure 10:
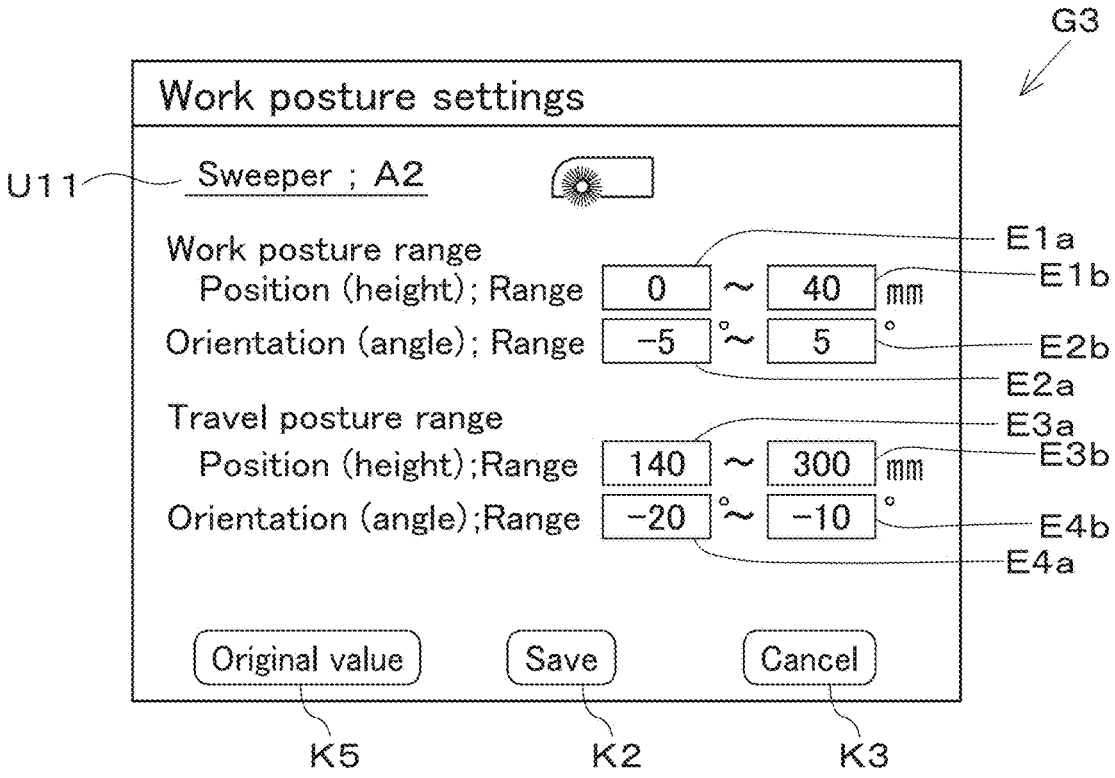
FIG. 10 illustrates an example of a posture settings screen.

For example, the following configuration may be used: the user can freely define and change the work posture range and the travel posture range of the attachment 11 via, for example, the user interface 22. FIG. 10 illustrates an example of a posture settings screen G3 for the attachment 11. The user such as the driver of the working machine 1 may tap a settings key K1 on the monitor screen G1 shown in, for example, FIG. 9A to cause the controller 20 to cause the user interface 22 to display the posture settings screen G3 as shown in FIG. 10.

The posture settings screen G3 displays the name, identification information U11, and icon of the attachment 11 attached to the working device 4, input boxes E1*a*, E1*b*, E2*a*, and E2*b* for the work posture range of the attachment 11, input boxes E3*a*, E3*b*, E4*a*, and E4*b* for the travel posture range, and operation keys K2, K3, and K5. In the example in FIG. 10, of the work posture range included in the control information of the attachment 11, the lower limit of the range of the position in the up-down direction (height) of the attachment 11 (work surface 11*w*) is displayed in the input box Ela, the upper limit of the range of the position is displayed in the input box E1*b*, the lower limit of the range of orientation (tilt angle) is displayed in the input box E2*a*, and the upper limit of the range of orientation is displayed in the input box E2*b*.

Of the travel posture range included in the control information, the lower limit of the range of the position in the up-down direction of the attachment 11 (work surface 11*w*) is displayed in the input box E3*a*, the upper limit of the range of the position is displayed in the input box E3*b*, the lower limit of the range of orientation is displayed in the input box E4*a*, and the upper limit of the range of orientation is displayed in the input box E4*b*.

For example, when the driver selects and taps one of the input boxes E1*a* to E4*b*, the controller 20 causes a numeric keyboard to be displayed on the posture settings screen G3 in a pop-up manner. When the driver selects one of the input boxes E1*a* and E4*b* and enters a changed value of the item corresponding to the selected input box E1 to E4*b* via the numeric keyboard, the controller 20 causes the changed value to be displayed in the corresponding input box E1*a* to E4*b*.

When the driver taps the save key K2, the controller 20 causes the storing device 21 to store the work posture range and the travel posture range displayed in the input boxes E1*a* to E4*b* as a changed work posture range and travel posture range of the attachment 11 indicated by the information inputted via the input interface(s) 22, 23, 24, and/or 28 such that the changed work posture range and travel posture range are associated with the attachment information and control information of the attachment 11. Alternatively, the controller 20 determines (calculates) at least one of the actuated positions of the lift cylinders 14 and the tilt cylinders 15 and the postures of the arms 10 and the hitch 16 relating to the work posture range and the travel posture range displayed in the input boxes E1*a* to E4*b*, and causes the storing device 21 to store information indicating the determined values such that the information are associated with the attachment information and control information.

After that, after the controller 20 starts a series of operation shown in FIGS. 8A and 8B, the controller 20 determines information relating to the changed work posture range and travel posture range at step S8 in FIG. 8A, and performs step S9 and subsequent steps.

Note that, after the changed value is displayed in one of the input boxes E1*a* to E4*b*, when the driver taps the original value key K5, the controller 20 discards the changed value and causes the original value to be displayed in the input box E1*a* to E4*b*. When the driver taps the cancel key K3, the controller 20 causes the user interface 22 to display the monitor screen G1 instead of the posture settings screen G3. Another example configuration may be such that only the work posture range and the travel posture range with regard to the position in the up-down direction of the attachment 11 can be inputted and changed on the posture settings screen G3.

The above description of the example embodiments discusses examples in which, with regard to attachments 11 other than contacting/moved attachments such as spreaders, the corresponding control information does not include posture information (FIG. 5) and such attachments 11 are not controlled by the controller 20 to automatically change to the travel posture or the work posture. However, also with regard to attachments 11 other than contacting/moved work attachments, the corresponding control information may include posture information and such attachments 11 may also be controlled by the controller 20 to automatically change to the travel posture or the work posture.

In the above described example embodiments, the work manual operator 67 includes a digital joystick. However, for example, as shown in FIG. 11, a pilot-operated hydraulic work manual operator 67 may be used instead.

Figure 11:
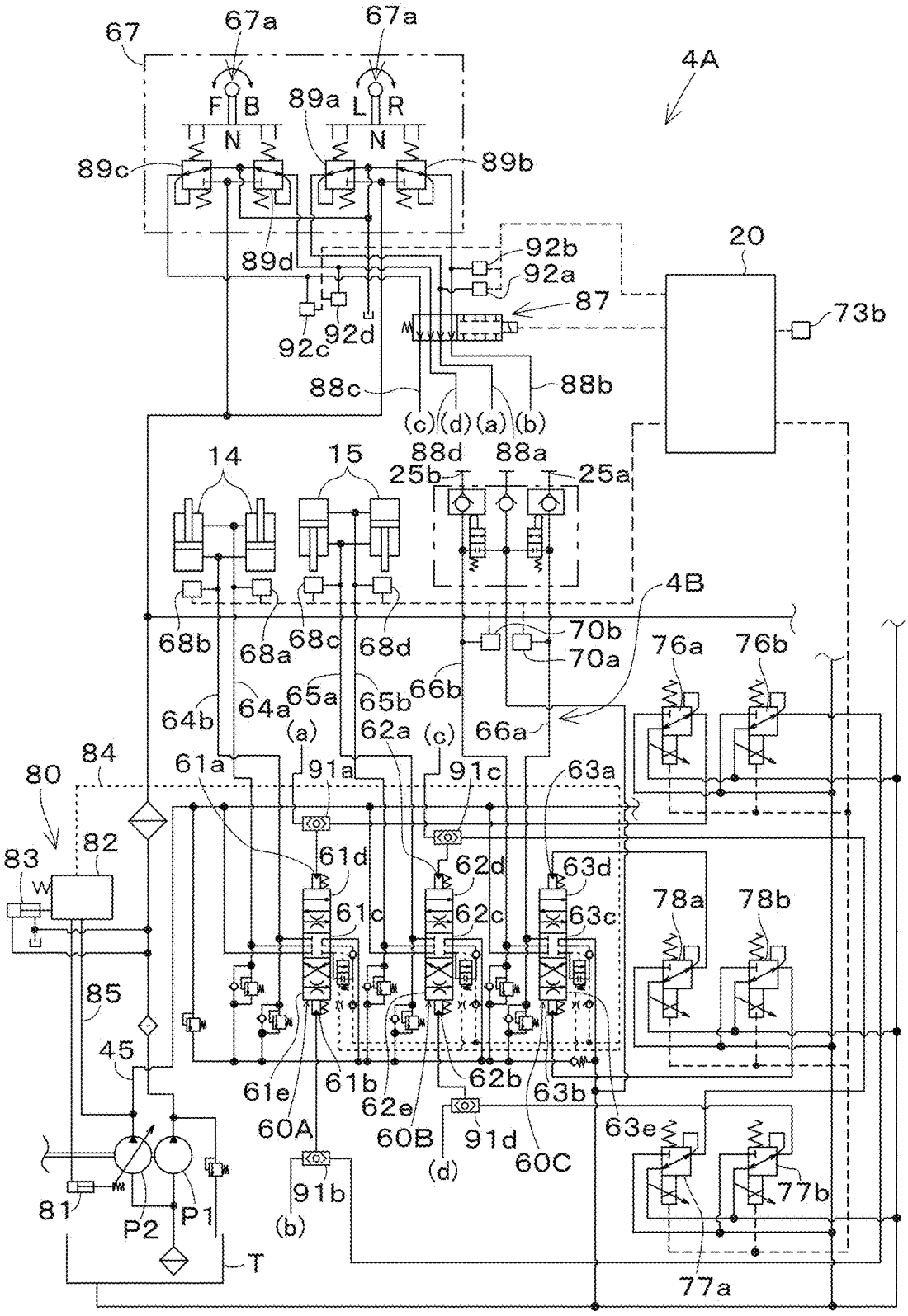
FIG. 11 illustrates another example of a work-related hydraulic circuit of a working machine.

The work manual operator 67 in a work-related hydraulic circuit 4A of another example embodiment shown in FIG. 11 includes a work operating lever 67*a* and a plurality of pilot valves 89*a*, 89*b*, 89*c* and 89*d*. The plurality of pilot valves

89*a* to 89*d* are connected to a fluid discharge passage 40 and are respectively connected to fluid passages 88*a*, 88*b*, 88*c* and 88*d*. The fluid passages 88*a*, 88*b*, 88*c* and 88*d* are respectively connected to corresponding work pressure receivers 61*a*, 61*b*, 62*a*, 62*b* of the lift control valve 60A and the tilt control valve 60B via high-pressure selection valves 91*a*, 91*b*, 91*c* and 91*d*. Note that, in FIG. 11, for convenience, a portion of the fluid passages 88*a*, 88*b*, 88*c* and 88*d* is omitted ((a), (b), (c), (d)).

The high-pressure selection valves 91*a*, 91*b*, 91*c*, 91*d* are each connected to the lift solenoid valve 76*a*, 76*b* or the tilt solenoid valve 77*a*, 77*b* via a fluid passage. Each of the high-pressure selection valves 91*a*, 91*b*, 91*c*, 91*d* allows a higher one of the hydraulic pressure from the connected pilot valve 89*a*, 89*b*, 89*c*, 89*d* and the hydraulic pressure from the connected solenoid valve 76*a*, 76*b*, 77*a*, 77*b* to act on the connected work pressure receiver 61*a*, 61*b*. The fluid passages 88*a* to 88*d* are provided with a solenoid switching valve 87. The solenoid switching valve 87 is a two-position solenoid switching valve, and switchable between a first position to allow passage of pilot fluid and a second position to block pilot fluid. Note that the solenoid switching valve 87 is normally in the first position.

When the work operating lever 67*a* is pivoted forward (direction F), the first pilot valve 89*a* is operated, and, after the pilot pressure of pilot fluid from the fluid discharge passage 40 is changed at the first pilot valve 89*a*, the pilot fluid passes through the first fluid passage 88*a* and the solenoid switching valve 87 and the pilot pressure acts on the work pressure receiver 61*a* of the lift control valve 60A. With this, the lift control valve 60A switches to the first position 61*d*, the lift cylinders 14 retract, and the arms 10 swing downward.

When the work operating lever 67*a* is pivoted rearward (direction B), the second pilot valve 89*b* is operated, and, after the pilot pressure of pilot fluid from the fluid discharge passage 40 is changed at the second pilot valve 89*b*, the pilot fluid passes through the second fluid passage 88*b* and the solenoid switching valve 87 and the pilot pressure acts on the work pressure receiver 61*b* of the lift control valve 60A. With this, the lift control valve 60A switches to the second position 61*e*, the lift cylinders 14 extend, and the arms 10 swing upward.

When the work operating lever 67*a* is pivoted leftward (direction L), the third pilot valve 89*c* is operated, and, after the pilot pressure of pilot fluid from the fluid discharge passage 40 is changed at the third pilot valve 89*c*, the pilot fluid passes through the third fluid passage 88*c* and the solenoid switching valve 87 and the pilot pressure acts on the work pressure receiver 62*a* of the tilt control valve 60B. With this, the tilt control valve 60B switches to the first position 62*d*, the tilt cylinders 15 extend, and the hitch 16 swings downward.

When the work operating lever 67*a* is pivoted rightward (direction R), the fourth pilot valve 89*d* is operated, and, after the pilot pressure of pilot fluid from the pilot fluid discharge passage 40 is changed at the fourth fluid passage 88*d*, the pilot fluid passes through the fourth fluid passage 88*d* and the solenoid switching valve 87 and the pilot pressure acts on the work pressure receiver 62*b* of the tilt control valve 60B. With this, the tilt control valve 60B switches to the second position 62*e*, the tilt cylinders 15 retract, and the hitch 16 swings upward.

The fluid passages 88*a*, 88*b*, 88*c* and 88*d* are provided with respective pressure detectors 92*a*, 92*b*, 92*c* and 92*d*. The pressure detectors 92*a*, 92*b*, 92*c* and 92*d* detect the pilot pressure outputted from the pilot valves 89*a*, 89*b*, 89*c* and 89*d*. The controller 20 may determine whether or not the work operating lever 67*a* is operated, the operation direction and operation amount of the work operating lever 67*a* based on the pilot pressure detected by the pressure detectors 92*a* to 92*d*.

The controller 20 is configured or programmed such that, when actuating at least one of the lift solenoid valves 76*a* and 76*b* or the tilt solenoid valves 77*a* and 77*b* to switch the position of at least one of the lift control valve 60A or the tilt control valve 60B to cause at least one of the arms 10 or the hitch 16 to swing, the controller 20 inputs a control signal into the solenoid switching valve 87 to switch the solenoid switching valve 87 to the second position. With this, the pilot pressure from the pilot valves 89*a* to 89*d* is blocked at the solenoid switching valve 87 and does not act on any of the work pressure receivers 61*a*, 61*b*, 62*a* and 62*b* of the lift control valve 60A and the tilt control valve 60B.

In the foregoing example embodiments, a hydraulic, pilot-operated travel manual operator 57 is used. Note, however, that the travel manual operator 57 may also include a digital joystick like the work manual operator 67 illustrated in FIG. 1, and may include some other electric manual operator capable of inputting, into the controller 20, an operation signal (electric signal) corresponding to the operation direction and operation amount of the travel operating lever 57*a*.

Working machines 1 of example embodiments described so far include features described in the following items and achieve the following effects.

(Item 1) A working machine 1 including a machine body 2, a working device 4 attached to the machine body 2, the working device 4 being operable to attach thereto an attachment 11 which is one of a plurality of attachments 11 to perform work, and change a posture of the attachment 11 attached thereto including a position of the attachment 11 in an up-down direction, a work manual operator 67 to be operated to actuate the working device 4 to change the posture of the attachment 11, a first input interface 22, 23, 24, 28 (user interface 22, beacon scanner 23, communicator 24, AUX connector 28) to receive input of information relating to the attachment 11 attached to the working device 4, and a controller 20 configured or programmed to control the working device 4, wherein the controller 20 is configured or programmed to, based on the information inputted via the first input interface, define a work posture range for the work performed by the attachment 11 and a travel posture range for the machine body 2 to travel, the travel posture range differing from the work posture range, and when the work manual operator 67 is operated to actuate the working device 4 and the posture of the attachment 11 changes to a posture falling within the travel posture range or the work posture range, stop actuating the working device 4 even while the work manual operator 67 is being operated.

With the configuration according to item 1, the posture of the attachment 11, which is to be changed by the operation of the work manual operator 67 by the driver of the working machine 1, does not change to a posture outside the travel posture range or the work posture range and is limited to travel postures falling within the travel posture range or work postures falling within the work posture range. This makes it possible to easily change the posture of the attachment 11 to the travel posture or the work posture. Thus, it is possible to reduce the burden on the driver of the working machine 1 to perform operations to change the posture of the attachment 11. Furthermore, since the travel posture range and the work posture range suitable for the attachment 11 attached to the working device 4 are defined, it is possible to appropriately change the posture of the attachment 11 to an appropriate travel posture falling within the travel posture range and an appropriate work posture falling within the work posture range, making it possible to improve the travel performance and work performance of the working machine 1 during travel. Furthermore, it is possible to eliminate or reduce the likelihood that the posture of the attachment 11 will significantly differ from the work posture, possible to quickly change the attachment 11 from the work posture to the travel posture or from the travel posture to the work posture, and possible to improve work performance.

(Item 2) The working machine 1 according to item 1, further including a seat 8, wherein the controller 20 is configured or programmed to, in a case that the attachment 11 corresponding to the information inputted via the first input interface 22, 23, 24, 28 is an attachment 11 to perform work by contacting a target object, define, based on the information, the work posture range in which the attachment 11 contacts the target object and the travel posture range in which the attachment 11 is positioned lower than the seat and is not in contact with the target object.

With the configuration according to item 2, in the case where the attachment 11 attached to the working device 4 is an attachment 11 to perform work by contacting a target object, it is possible to bring the attachment 11 into an appropriate travel posture and work posture, making it possible to improve the travel performance and work performance of the working machine 1 during travel. Furthermore, when the attachment 11 is in the travel posture, it is possible to eliminate or reduce the likelihood that the attachment 11 will block the sight of the driver seated in the seat, and possible to ensure the operability of the working machine 1 by the driver.

(Item 3) The working machine 1 according to item 2, wherein the controller 20 is configured or programmed to stop actuating the working device 4 when the work manual operator 67 is operated, while the posture of the attachment 11 is in the work posture range, in the travel posture range, or in an in-between range between the work posture range and the travel posture range, to actuate the working device 4 and the posture of the attachment 11 changes to a posture falling within the travel posture range or the work posture range.

With the configuration according to item 3, when it is estimated from the posture of the attachment 11 and the operation of the work manual operator 67 that the driver wishes to bring the attachment 11 into the travel posture or the work posture, it is possible to easily and appropriately set the attachment 11 in the travel posture or the work posture.

(Item 4) The working machine 1 according to item 3, wherein the controller 20 is configured or programmed to, when the work manual operator 67 is operated to actuate the working device 4 while the posture of the attachment 11 is not in the work posture range, in the travel posture range, or in the in-between range, not stop actuating the working device 4 as long as the work manual operator 67 is being operated even when the posture of the attachment 11 changes to a posture falling within the travel posture range or the work posture range.

With the configuration according to item 4, when the driver has set the attachment 11 in another posture other than the travel posture and the work posture, the driver can operate the work manual operator 67 to freely adjust such a posture of the attachment 11, making it possible to improve convenience. It is also possible to eliminate or reduce the likelihood that the posture of the attachment 11 will be unnecessarily limited to the travel postures falling within the travel posture range or the work postures falling within the work posture range.

(Item 5) The working machine 1 according to any one of items 1 to 4, wherein the controller 20 is configured or programmed to, when the work manual operator 67 is operated to actuate the working device 4 and the posture of the attachment 11 changes to the travel posture range, stop actuating the working device 4 to set the posture of the attachment 11 at a predetermined travel posture falling within the travel posture range, and when the work manual operator 67 is operated to actuate the working device 4 and the posture of the attachment 11 changes to the work posture range, stop actuating the working device 4 to set the posture of the attachment 11 at a predetermined work posture falling within the work posture range.

With the configuration according to item 5, the driver can operate the work manual operator 67 to reliably and appropriately change the posture of the attachment 11 to the travel posture or the work posture.

(Item 6) The working machine 1 according to any one of items 1 to 5, further including a detector 37, 38 (arm detector 37, hitch detector 38) to detect a posture of the working device 4 that includes a position of the working device 4 in an up-down direction, wherein the controller 20 is configured or programmed to stop actuating the working device 4 when the work manual operator 67 is operated to actuate the working device 4 and the posture of the working device 4 changes to a posture falling within a range corresponding to the travel posture range or a range corresponding to the work posture range.

With the configuration according to item 6, the controller 20 is able to appropriately control the actuation and stopping of the working device 4 to appropriately change the posture of the attachment 11 to the travel posture or the work posture based on changes in posture of the working device 4 detected by the detector(s) 37, 38, without having to determine the posture of the attachment 11 from the detection result from the detector(s) 37, 38 and monitor the posture. It is also possible to reduce the processing load on the controller 20.

(Item 7) The working machine 1 according to any one of items 1 to 6, wherein the working device 4 includes an arm 10 connected to the machine body 2 swingably in the up-down direction, and a hitch 16 connected to a distal portion of the arm 10 to attach and detach the attachment 11 thereto and therefrom, and a first actuator (lift cylinder) 14 to swing the arm 10, wherein the controller 20 is configured or programmed to stop actuating the first actuator 14 when the work manual operator 67 is operated, while an actuated position of the first actuator 14 is in a first range (work actuation range) corresponding to the work posture range, in a second range (travel actuation range) corresponding to the travel posture range, or in a third range (in-between range) between the first range and the second range, to actuate the first actuator 14 and the actuated position of the first actuator 14 changes the second range or the first range.

With the configuration according to item 7, in response to changes in actuated position of the first actuator(s) 14 which allows estimation that the driver wishes to bring the attachment 11 into the travel posture or the work posture, the controller 20 easily and appropriately sets the attachment 11 in the travel posture or the work posture. Furthermore, the controller 20 is able to appropriately and reliably change the posture (position in the up-down direction) of the attachment 11 to the travel posture or the work posture without having to determine the posture of the attachment 11 and monitor the posture, making it possible to reduce the processing load on the controller 20.

(Item 8) The working machine 1 according to item 7, wherein the controller 20 is configured or programmed to reduce an actuation speed of the first actuator 14 as the actuated position of the first actuator 14 approaches from the third range to the second range or to the first range.

With the configuration according to item 8, when the actuated position of the first actuator(s) 14 is changed to the second range or the first range by operation of the work manual operator 67, by stopping the actuation of the first actuator(s) 14, it is possible to cause the actuated position of the first actuator(s) 14 to remain in the second range or the first range, making it possible to reliably set the posture (position in the up-down direction) of the attachment 11 in the travel posture or the work posture.

(Item 9) The working machine 1 according to item 7 or 8, wherein the hitch 16 is connected to the distal portion of the arm 10 swingably in the up-down direction, the working device 4 includes a second actuator (tilt cylinders) 15 to swing the hitch 16, and the controller 20 is configured or programmed to stop actuating the second actuator 15 when the work manual operator 67 is operated, while an actuated position of the second actuator 15 is in a fourth range (work actuation range) corresponding to the work posture range, in a fifth range (travel actuation range) corresponding to the travel posture range, or in a sixth range (in-between range) between the fourth range and the fifth range, to actuate the second actuator 15 and the actuated position of the second actuator 15 changes to the fifth range or the fourth range.

With the configuration according to item 9, in response to changes in actuated position of the second actuator(s) 15 which allows estimation that the driver wishes to bring the attachment 11 into the travel posture or the work posture, the controller 20 easily and appropriately sets the attachment 11 in the travel posture or the work posture. Furthermore, the controller 20 is able to appropriately and reliably change the posture (orientation) of the attachment 11 to the travel posture or the work posture without having to determine the posture of the attachment 11 and monitor the posture, making it possible to reduce the processing load on the controller 20.

(Item 10) The working machine 1 according to item 9, wherein the controller 20 is configured or programmed to reduce an actuation speed of the second actuator 15 as the actuated position of the second actuator 15 approaches from the sixth range to the fifth range or to the fourth range.

With the configuration according to item 10, when the actuated position of the second actuator(s) 15 is changed to the fifth range or the fourth range by operation of the work manual operator 67, by stopping the actuation of the second actuator(s) 15, it is possible to cause the actuated position of the second actuator(s) 15 to remain in the fifth range or the fourth range, making it possible to reliably set the posture (orientation) of the attachment 11 in the travel posture or the work posture.

(Item 11) The working machine 1 according to any one of items 3 to 10, wherein the controller 20 is configured or programmed to, when, after the work manual operator 67 is operated in a first direction and the posture of the attachment 11 changes to a posture falling within the travel posture range or the work posture range and actuation of the working device 4 is stopped, the work manual operator 67 is operated to a neutral position and then is operated again in the first direction, permit the posture of the attachment 11 to change to another posture not falling within the travel posture range or the work posture range by actuation of the working device 4 caused by the work manual operator 67 thus operated again.

With the configuration according to item 11, when the driver operates the work manual operator 67 in a first direction and then operates the work manual operator 67 back to the neutral position and then operates the work manual operator 67 again in the first direction, it is possible to change the posture of the attachment 11 to another posture not falling within the travel posture range or the work posture range, making it possible to improve convenience.

(Item 12) The working machine 1 according to any one of items 3 to 11, further including a power output circuit (auxiliary hydraulic circuit) 4B to output power to an auxiliary actuator 27 provided in or on the attachment 11 to drive the attachment 11, wherein the controller 20 is configured or programmed to, in a case that the attachment 11 indicated by the information inputted via the first input interface 22, 23, 24, 28 is a specific attachment 11 including the auxiliary actuator 27, stop actuating the working device 4 when the work manual operator 67 is operated while the controller 20 is in a steady output mode and the posture of the attachment 11 is within the work posture range, within the travel posture range, or within the in-between range and the posture of the attachment 11 changes to a posture falling within the travel posture range or the work posture range, the steady output mode being a mode in which the controller 20 keeps constant a state of power output from the power output circuit 4B to the auxiliary actuator 27.

With the configuration according to item 12, in the case where the attachment 11 attached to the working device 4 is a specific attachment 11 including an auxiliary actuator 27, when it is estimated from the steady output mode, the posture of the attachment 11, and the operation of the work manual operator 67 that the driver wishes to bring the attachment 11 into the travel posture or the work posture, it is possible to easily and appropriately set the attachment 11 in the travel posture or the work posture. In cases where the power for the auxiliary actuator 27 is the hydraulic pressure of hydraulic fluid and the working device 4 is also actuated by the hydraulic pressure, since it is not necessary to control the working device 4 in consideration of changes in hydraulic pressure for the auxiliary actuator 27, it is possible to reduce the processing load on the controller 20.

(Item 13) The working machine 1 according to item 12, wherein the controller 20 is configured or programmed to, when the controller 20 is not in the steady output mode, permit the posture of the attachment 11 to change to another posture not falling within the travel posture range or the work posture range by actuation of the working device 4 caused by operation of the work manual operator 67.

With the configuration according to item 13, when, for example, the driver wishes to appropriately change the state of power output from the power output circuit 4B to the auxiliary actuator 27 to perform intended work using the attachment 11, the driver can operate the work manual operator 67 to change the posture of the attachment 11 freely to a posture falling within the travel posture range, the work posture range, the in-between range, or some other range, making it possible to improve convenience.

(Item 14) The working machine 1 according to item 12 or 13, wherein the controller 20 is configured or programmed to not enter the steady output mode when the posture of the attachment 11 does not fall within the work posture range, the travel posture range, or the in-between range.

With the configuration according to item 14, when the attachment 11 is in a posture which allows estimation that the attachment 11 does not perform work, the control for the steady output mode suitable for the work is not performed needlessly, making it possible to reduce the processing load on elements such as the controller 20 that relate to the control.

(Item 15) The working machine 1 according to any one of items 1 to 14, wherein the controller 20 is configured or programmed to select, from a memory and/or a storage 21 to store one or more of the work posture ranges and one or more of the travel posture ranges defined for a respective one or more of the attachments 11 attachable to the working device 4, information relating to the corresponding work posture range and information relating to the corresponding travel posture range based on the information inputted via the first input interface 22, 23, 24, 28.

(Item 16) The working machine 1 according to any one of items 1 to 14, wherein the controller 20 is configured or programmed to select information relating to at least one of the work posture range or the travel posture range included in the information inputted via the first input interface 22, 23, 24, 28.

With the configuration according to item 15 or 16, it is possible to define the work posture range and the travel posture range of the working device 4 or the range of the actuated position(s) of the actuators 14 and/or 15 relating to the work posture range and the travel posture range corresponding to the attachment 11 attached to the working device 4, and, based on the defined information, possible to appropriately estimate that the posture of the attachment 11 is in the work posture range or the travel posture range. It is also possible to change the attachment 11 to an appropriate work posture and to an appropriate travel posture, and thus possible to improve work performance and travel performance.

(Item 17) The working machine 1 according to any one of items 1 to 16, further including a second input interface (user interface) 22 to receive input of a changed value of the work posture range and/or the travel posture range defined by the controller 20.

With the configuration according to item 17, for example, the driver can freely change the work posture range and the travel posture range of the attachment 11 using the second input interface 22 depending on the situation of the worksite, etc. This makes it possible to improve convenience, work performance, and travel performance of the working machine 1 during travel.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body;

a working device attached to the machine body, the working device being operable to:

attach thereto an attachment which is one of a plurality of attachments to perform work; and change a posture of the attachment attached thereto including a position of the attachment in an up-down direction;

a work manual operator to be operated to actuate the working device to change the posture of the attachment;

a first input interface to receive input of information relating to the attachment attached to the working device; and a controller configured or programmed to control the working device; wherein the controller is configured or programmed to:

based on the information inputted via the first input interface, define a work posture range for the work performed by the attachment and a travel posture range for the machine body to travel, the travel posture range differing from the work posture range; and when the work manual operator is operated to actuate the working device and the posture of the attachment changes to a posture falling within the travel posture range or the work posture range, stop actuating the working device even while the work manual operator is being operated.

2. The working machine according to claim 1, further comprising a seat; wherein the controller is configured or programmed to, in a case that the attachment corresponding to the information inputted via the first input interface is an attachment to perform work by contacting a target object, define, based on the information, the work posture range in which the attachment contacts the target object and the travel posture range in which the attachment is positioned lower than the seat and is not in contact with the target object.

3. The working machine according to claim 1, wherein the controller is configured or programmed to stop actuating the working device when the work manual operator is operated, while the posture of the attachment is in the work posture range, in the travel posture range, or in an in-between range between the work posture range and the travel posture range, to actuate the working device and the posture of the attachment changes to a posture falling within the travel posture range or the work posture range.

4. The working machine according to claim 3, wherein the controller is configured or programmed to, when the work manual operator is operated to actuate the working device while the posture of the attachment is not in the work posture range, in the travel posture range, or in the in-between range, not stop actuating the working device as long as the work manual operator is being operated even when the posture of the attachment changes to a posture falling within the travel posture range or the work posture range.

5. The working machine according to claim 3, wherein the controller is configured or programmed to, when, after the work manual operator is operated in a first direction and the posture of the attachment changes to a posture falling within the travel posture range or the work posture range and actuation of the working device is stopped, the work manual operator is operated to a neutral position and then is operated again in the first direction, permit the posture of the attachment to change to another posture not falling within the travel posture range or the work posture range by actuation of the working device caused by the work manual operator thus operated again.

6. The working machine according to claim 3, further comprising a power output circuit to output power to an auxiliary actuator provided in or on the attachment to drive the attachment; wherein the controller is configured or programmed to, in a case that the attachment indicated by the information inputted via the first input interface is a specific attachment including the auxiliary actuator, stop actuating the working device when the work manual operator is operated while the controller is in a steady output mode and the posture of the attachment is within the work posture range, within the travel posture range, or within the in-between range and the posture of the attachment changes to a posture falling within the travel posture range or the work posture range, the steady output mode being a mode in which the controller keeps constant a state of power output from the power output circuit to the auxiliary actuator.

7. The working machine according to claim 6, wherein the controller is configured or programmed to, when the controller is not in the steady output mode, permit the posture of the attachment to change to another posture not falling within the travel posture range or the work posture range by actuation of the working device caused by operation of the work manual operator.

8. The working machine according to claim 6, wherein the controller is configured or programmed to not enter the steady output mode when the posture of the attachment does not fall within the work posture range, the travel posture range, or the in-between range.

9. The working machine according to claim 1, wherein the controller is configured or programmed to:

when the work manual operator is operated to actuate the working device and the posture of the attachment changes to the travel posture range, stop actuating the working device to set the posture of the attachment at a predetermined travel posture falling within the travel posture range; and when the work manual operator is operated to actuate the working device and the posture of the attachment changes to the work posture range, stop actuating the working device to set the posture of the attachment at a predetermined work posture falling within the work posture range.

10. The working machine according to claim 1, further comprising a detector to detect a posture of the working device that includes a position of the working device in an up-down direction; wherein the controller is configured or programmed to stop actuating the working device when the work manual operator is operated to actuate the working device and the posture of the working device changes to a posture falling within a range corresponding to the travel posture range or a range corresponding to the work posture range.

11. The working machine according to claim 1, wherein the working device includes:

an arm connected to the machine body swingably in the up-down direction; and a hitch connected to a distal portion of the arm to attach and detach the attachment thereto and therefrom; and a first actuator to swing the arm; wherein the controller is configured or programmed to stop actuating the first actuator when the work manual operator is operated, while an actuated position of the first actuator is in a first range corresponding to the work posture range, in a second range corresponding to the travel posture range, or in a third range between the first range and the second range, to actuate the first actuator and the actuated position of the first actuator changes to the second range or the first range.

12. The working machine according to claim 11, wherein the controller is configured or programmed to reduce an actuation speed of the first actuator as the actuated position of the first actuator approaches from the third range to the second range or to the first range.

13. The working machine according to claim 11, wherein the hitch is connected to the distal portion of the arm swingably in the up-down direction;

the working device includes a second actuator to swing the hitch; and the controller is configured or programmed to stop actuating the second actuator when the work manual operator is operated, while an actuated position of the second actuator is in a fourth range corresponding to the work posture range, in a fifth range corresponding to the travel posture range, or in a sixth range between the fourth range and the fifth range, to actuate the second actuator and the actuated position of the second actuator changes to the fifth range or the fourth range.

14. The working machine according to claim 13, wherein the controller is configured or programmed to reduce an actuation speed of the second actuator as the actuated position of the second actuator approaches from the sixth range to the fifth range or to the fourth range.

15. The working machine according to claim 1, wherein the controller is configured or programmed to select, from a memory and/or a storage to store one or more of the work posture ranges and one or more of the travel posture ranges defined for a respective one or more of the attachments attachable to the working device, information relating to the corresponding work posture range and information relating to the corresponding travel posture range based on the information inputted via the first input interface.

16. The working machine according to claim 1, wherein the controller is configured or programmed to select information relating to at least one of the work posture range or the travel posture range included in the information inputted via the first input interface.

17. The working machine according to claim 1, further comprising a second input interface to receive input of a changed value of the work posture range and/or the travel posture range defined by the controller.

* * * * *